US005758813A

United States Patent [19]

Kikuchi et al.

[11] Patent Number: 5,758,813

[45] Date of Patent: Jun. 2, 1998

[54] DRIVER-AND-CLINCHER OPERATING MECHANISM FOR STAPLER

[75] Inventors: Toshiaki Kikuchi; Takahisa Misawa, both of Tokyo, Japan

[73] Assignee: The MAX Co., Ltd., Tokyo, Japan

[21] Appl. No.: 708,980

[22] Filed: Sep. 6, 1996

[30] Foreign Application Priority Data

| | | | |
|---|---|---|---|
| Sep. 7, 1995 | [JP] | Japan | 7-257086 |
| Sep. 7, 1995 | [JP] | Japan | 7-257087 |
| Sep. 7, 1995 | [JP] | Japan | 7-257088 |

[51] Int. Cl.[6] ..... B25C 5/02

[52] U.S. Cl. ..... 227/155; 227/134

[58] Field of Search ..... 227/5, 131, 129, 227/155, 7, 134

[56] References Cited

U.S. PATENT DOCUMENTS

| | | | |
|---|---|---|---|
| 1,962,874 | 6/1934 | Polzer | 1/3 |
| 4,199,095 | 4/1980 | Yamanoi | 227/155 |
| 4,720,033 | 1/1988 | Olesen | 227/155 |
| 4,844,319 | 7/1989 | Kurosawa | 227/155 |
| 5,007,572 | 4/1991 | Chung-Cheng | 227/155 |
| 5,009,355 | 4/1991 | Akizawa et al. | 227/155 |
| 5,195,671 | 3/1993 | Jairam | 227/7 |
| 5,413,266 | 5/1995 | Jairam | 227/129 |

FOREIGN PATENT DOCUMENTS

| | | |
|---|---|---|
| 94 16 512 | 3/1995 | Germany . |
| 462957 | 3/1937 | United Kingdom . |

*Primary Examiner*—Scott A. Smith

*Attorney, Agent, or Firm*—Morgan, Lewis & Bockius LLP

[57] ABSTRACT

A stapler includes a driver-and-clincher mechanism for operating a driver and a clincher such that the driver-and-clincher operating mechanism operates the driver until the driver nearly reaches a bottom dead point thereof during a first half downward movement of an operating handle and then the driver-and-clincher mechanism operates the clincher during a latter half movement of the operating handle.

8 Claims, 27 Drawing Sheets

28
29
27
17
16
25
26
25a
30
25c
30b
30a
WAITING
DRIVER TEMPORARY STOP
STAND-BY

DRIVER-AND-CLINCHER OPERATING MECHANISM FOR STAPLER

BACKGROUND OF THE INVENTION

The invention relates to a stapler, more specifically, a driver-and-clincher operating mechanism that not only causes staples to pierce a pile of sheets by an operating handle but also causes the legs of the staples to be bent by a movable clincher.

Clinch mechanisms for ordinary staplers have two types: a firs type that the legs of staples that have pierced a pile of sheets are bent by a fixed clincher groove; and a second type that a clincher is driven to bend the legs of staples after the legs have pierced a pile of sheets. The latter type clinch mechanism is disclosed in, for instance, Examined Japanese Utility Model No. Hei. 6-16664. This publication relates to a clincher mechanism that bends the legs of staples flat by driving a clincher vertically. In figures of the aforementioned publication, it is disclosed that clinchers are vertically moved together with a guide member.

The clinch mechanism disclosed in the aforementioned publication is so designed that the clinchers are turned while interlocking with downward movement of the guide member by releasing the supporting of the guide member after the driver has caused the staples to pierce the pile of sheets.

According to the aforementioned construction in which the clinchers are vertically moved, a pile of sheets is curved as shown in FIG. 33. Hence, the middle part of the pile of sheets rises when staples are hammered at two positions. It is for this reason that a system that is designed not to move a clincher vertically has been called for.

However, in order to turn the movable clincher without vertically moving the clincher section, it is required that the timing at which to cause the staples to pierce the pile of sheets by operating the operating handle and the timing at which to turn the movable clincher be adjusted. This adjustment has been extremely difficult.

By the way, in the aforementioned clinching system using the movable clinchers, the movable clinchers are usually opened. Therefore, staples may enter into the space between the opened pair of clinchers to thereby block the turning of the clinchers. As a result, defective binding may be caused. To overcome this problem, known is a clincher system having a mechanism for urging the clinchers to be closed at all times by arranging a clincher receiver under the clinchers and forcibly pushing the clincher receiver upward by a spring.

However, the aforementioned mechanism requires that the clincher receiver and the spring be arranged to close the clincher, which in turn elevates the cost of manufacture.

SUMMARY OF THE INVENTION

The invention has been made to eliminate the aforementioned problem.

An object of the invention is therefore to provide a driver temporary stopping mechanism for a stapler which temporarily stops only the driver during the operation of the operating handle so that the movable clincher can be turned while the driver is temporarily stopped.

Another object of the invention is therefore to provide a driver-and-clincher mechanism for a stapler capable of binding a pile of sheets without moving a clincher section vertically and maintaining the timings at which to operate a driver and a movable clincher constant irrespective of the thickness of a pile of sheets.

Still further object of the invention is to overcome the aforementioned problem and provide a movable clincher operating mechanism for a stapler that can close the movable clinchers without requiring special components.

According to a first aspect of the invention, there is provided a stapler for piercing staples to a pile of sheets and bending legs of the staples, comprising: a movable clincher for bending the legs of staples along a bottom surface of the pile of sheets; a base member accommodating the movable clincher; a clincher operating mechanism for operating the movable clincher; a magazine in which the staples are loaded, a driver holder having a first guide groove; a driver attached to the driver holder, for hammering the forefront staple; a frame member having a second guide groove, and connecting to the base member swingable with respect to the base member wherein the frame member accommodates the magazine and the frame member supports the driver holder vertically movable; an operating handle having a third guide groove, and supported by the base member to be vertically movable; and an operating pin is engaged with the first, second and third guide grooves, for regulating a movement of the driver while interlocking with a movement of the operating handle to temporarily stop the driver immediately before the driver reaches a bottom dead point thereof.

According to a second aspect of the invention, there is provided a stapler for piercing staples to a pile of sheets and bending legs of the staples, comprising: a movable clincher for bending the legs of staples along a bottom surface of the pile of sheets; an operating member for operating the movable clincher; a base member accommodating the movable clincher and the operating member; a magazine in which the staples are loaded; a driver hammering the forefront staple; a frame member connecting to the base member swingable with respect to the base member, and accommodating the magazine and the driver, wherein the frame member supports the driver vertically movable; an operating handle supported by the base member so as to be vertically movable; an operating mechanism connecting with the operating handle and the driver, wherein the operating mechanism operates the driver while interlocking with a downward movement of the operating handle; a link mechanism connecting with the operating handle and the frame member, wherein the link mechanism operates the operating member such that the driver operating mechanism is operated until the driver nearly reaches a bottom dead point thereof during a first half downward movement of the operating handle and then the link mechanism is operated during a latter half movement of the operating handle, whereby the movable clincher is operated by the operating member; and a paper thickness adjusting mechanism for preventing the operating member from operating irrespective of the thickness of a pile of sheets until the frame member comes in contact with an upper surface of the pile of sheets.

The paper thickness adjusting mechanism may be designed so that: the links are loosely coupled through an elongated hole and a pin; a journal of the frame member and the position at which the link mechanism engages with the operating member are placed close to each other independently of the thickness of a pile of sheets; or a displacement of the link mechanism which depends on the thickness of a pile of sheets is substituted for by a displacement of the operating member along the engagement surface.

According to a third aspect of the invention, there is provided a stapler of the second aspect, wherein instead of forming the first and second guide grooves in the driver holder, and the frame member, respectively, the operating pin is formed on the driver holder and engages with the third guide groove, for controlling the movement of the driver by the operating pin guided by the third guide groove while interlocking with the movement of the operating handle.

According to a forth aspect of the invention, there is provided a stapler for piercing staples to a pile of sheets and bending legs of the staples, comprising: a movable clincher for bending the legs of staples along a bottom surface of the pile of sheets; a base member accommodating the movable clincher; a clincher operating mechanism for operating the movable clincher; a magazine in which the staples are loaded; a driver holder; a driver attached to the driver holder, for hammering the forefront staple; a frame member connecting to the base member swingable with respect to the base member wherein the frame member accommodates the magazine and the frame member supports the driver holder vertically movable; an operating handle supported by the base member to be vertically movable; and a clincher operating mechanism for operating the movable clincher, the clincher operating mechanism including, an operating member arranged on the base member so as to be movable to a first position at which the movable clincher is operated to bend the staples and to a second position at which the movable clincher frees the staples, and a link mechanism allowing the operating member to move from the second position to the first position while interlocking with a downward movement of the operating handle, wherein, when the frame member is located at an upper position, the link mechanism is located at such a position as to allow the operating member to move toward the first position, and when the frame member is moved downward, the link mechanism is located at such a position as to allow the operating member to move toward the second position.

DETAILED DESCRIPTION OF THE PREFERRED EMBODIMENTS

Figure 1:
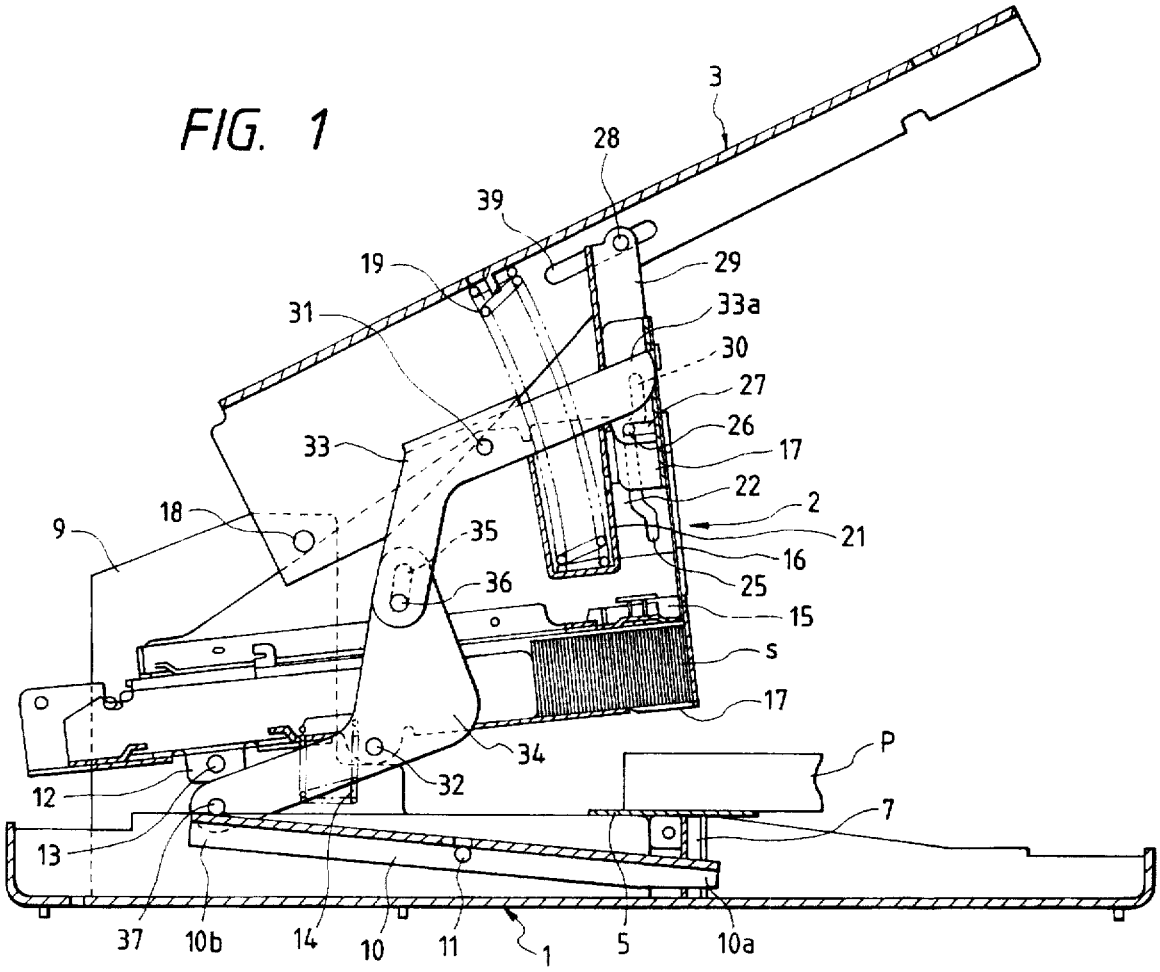
FIG. 1 is a diagram illustrative of a stapler including a clinch mechanism of the invention in cross section.

FIG. 1 shows a stapler which has a driver-and-clincher mechanism of the present invention and which is used while placed on a desk. In FIG. 1, reference numeral 1 denotes a base member; 2, a frame member; and 3, an operating handle.

Figure 5A:
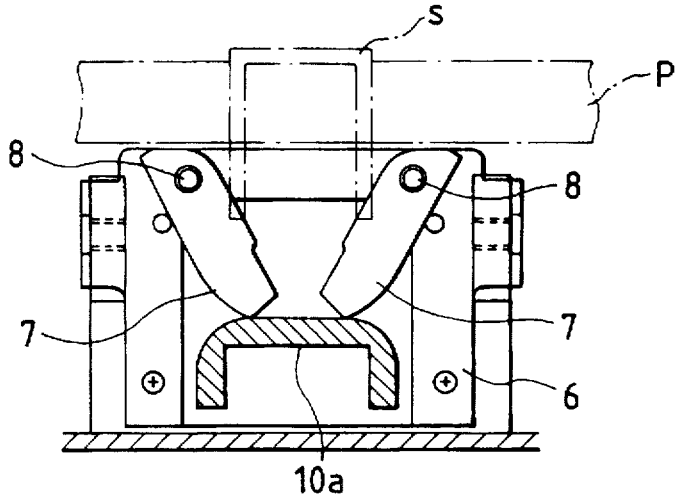
FIGS. 5(*a*) and 5(*b*) are illustrative of an operation mode of movable clinchers of the stapler.
Figure 5B:
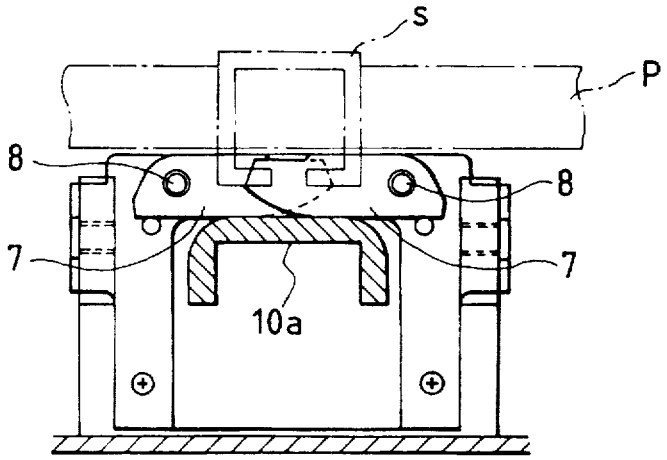

A binding table 5 is formed on the upper and almost middle part of the base member 1. A pair of movable clinchers 7 are arranged on support plates 6 so as to be rotatable about shafts 8, respectively (see FIG. 5). The support plates 6 are located below the binding table 5. Rising walls 9 are formed on both front sides of the base member 1 so as to project from the base member 1.

Further, the middle part of an operating member 10 is rotatably supported by a shaft 11 on the base member 1, so that a rear end 10*a* of the operating member 10 can turn the movable clinchers 7 when the operating member 10 is turned.

Projecting pieces 12 project downward from both front sides of the frame member 2. These projecting pieces 12 are not only supported by a journal 13 so that the frame member 2 can turn with respect to the base member 1, but also urged so that the frame member 2 can swing upward at all times with a spring 14. In addition, inside the frame member 2 is a magazine unit 15. The magazine unit 15 is so formed as to accommodate staples s therein. Moreover, on the rear end of the frame member 2 are a driver 16 and a holder 17 for the driver 16. The driver 16 and the driver holder 17 are guided and held so as to be vertically slidable. It may be noted that a hammering opening is formed so as to pass through the upper and lower portions on the rear end of the magazine unit 15. The hammering opening is designed to allow the driver 16 and the forefront staple s to be hammered out.

The operating handle 3 is supported by a journal 18 so that the operating handle 3 can swing with respect to the base member 1. The journal 18 passes through the rising walls 9 of the base member 1. The operating handle 3 is also urged by a spring 19 so that the operating handle 3 can swing upward with respect to the frame member 2 at all times.

An operating mechanism for operating the driver 16 and a link mechanism for operating the operating member 10 of the movable clinchers 7 are disposed on the operating handle 3 and the frame member 2. The operating mechanism and the link mechanism served as a driver-and-clincher operating mechanism.

Figure 6:
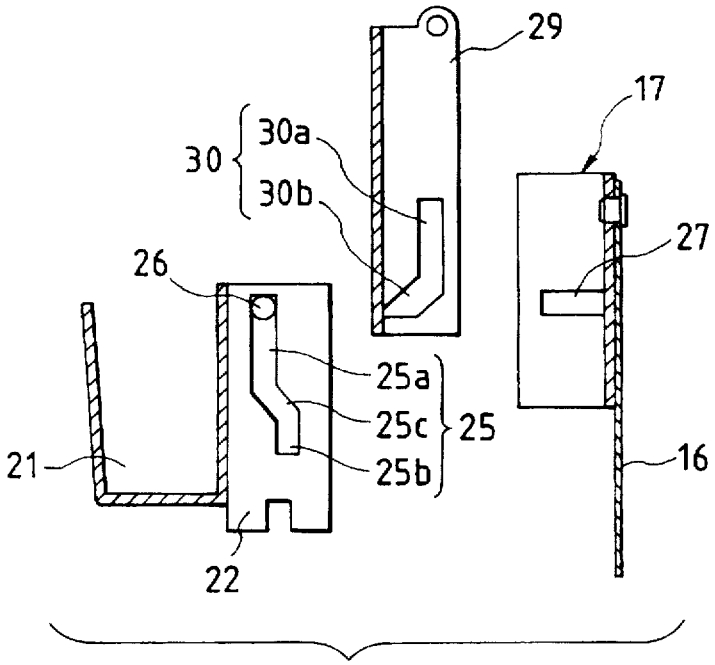
FIG. 6 is a exploded view of the driver operating mechanism of the stapler.

The driver operating mechanism is constructed as follows. First, as shown in FIGS. 1 and 6, a sliding groove 22 which vertically extends is formed in the front of a spring shoe 21 of the spring 19 of the frame member 2. On both side walls of the sliding groove 22 are first guide grooves 25 which vertically extend Z-shape. Each first guide groove 25 has an upper groove portion 25*a* and a lower groove portion 25*b* coupled through an inclined groove portion 25*c*. An operating pin 26 is slidably engaged with the first guide grooves 25.

Further, the drive holder 17 is guided and held by the sliding groove of the frame member 2 so as to be vertically slidable. The driver holder 17 is square C-shaped in cross section, holds the driver 16 in a middle piece thereof, and has a second guide groove 27 horizontally extending straight in a side piece thereof. The operating pin 26 is slidably engaged also with the second guide groove 27.

Further, an elongated hole 39 is formed in a side wall of the middle part of the operating handle 3, and an operating means 29 of the driver 16 is coupled to an engaging shaft 28 that is engaged with the elongated hole 39. The operating means 29 is also square C-shaped in cross section, and is held by the sliding groove of the frame member 2 so as to be vertically slidable. A J-shaped third guide groove 30 is formed in a side piece of the operating means 29. The third guide groove 30 has a longitudinal groove portion 30*a* vertically extending and an inclined groove position 30*b* formed continuously. The operating pin 26 is slidably engaged also with the third guide groove 30.

The link mechanism includes: a first link 33 and a second link 34 that are arranged on a side wall of the frame member 2. The first link 33 is supported by a first rotary shaft 31 and the second link 34 is supported by a second rotary shaft 32. An elongated hole 35 is formed on one end of the second link 34, and a shaft 36 arranged on one end of the first link 33 is engaged with the elongated hole 35, so that both links are coupled to each other. Further, an end portion 33*a* of the first link 33 is engageable with the engaging shaft 28 of the operating handle 3. An operating shaft 37 is arranged on the other end of the second link 34. The operating shaft 37 is engageable with an upper front end 10*b* of the operating member 10.

Figure 2:
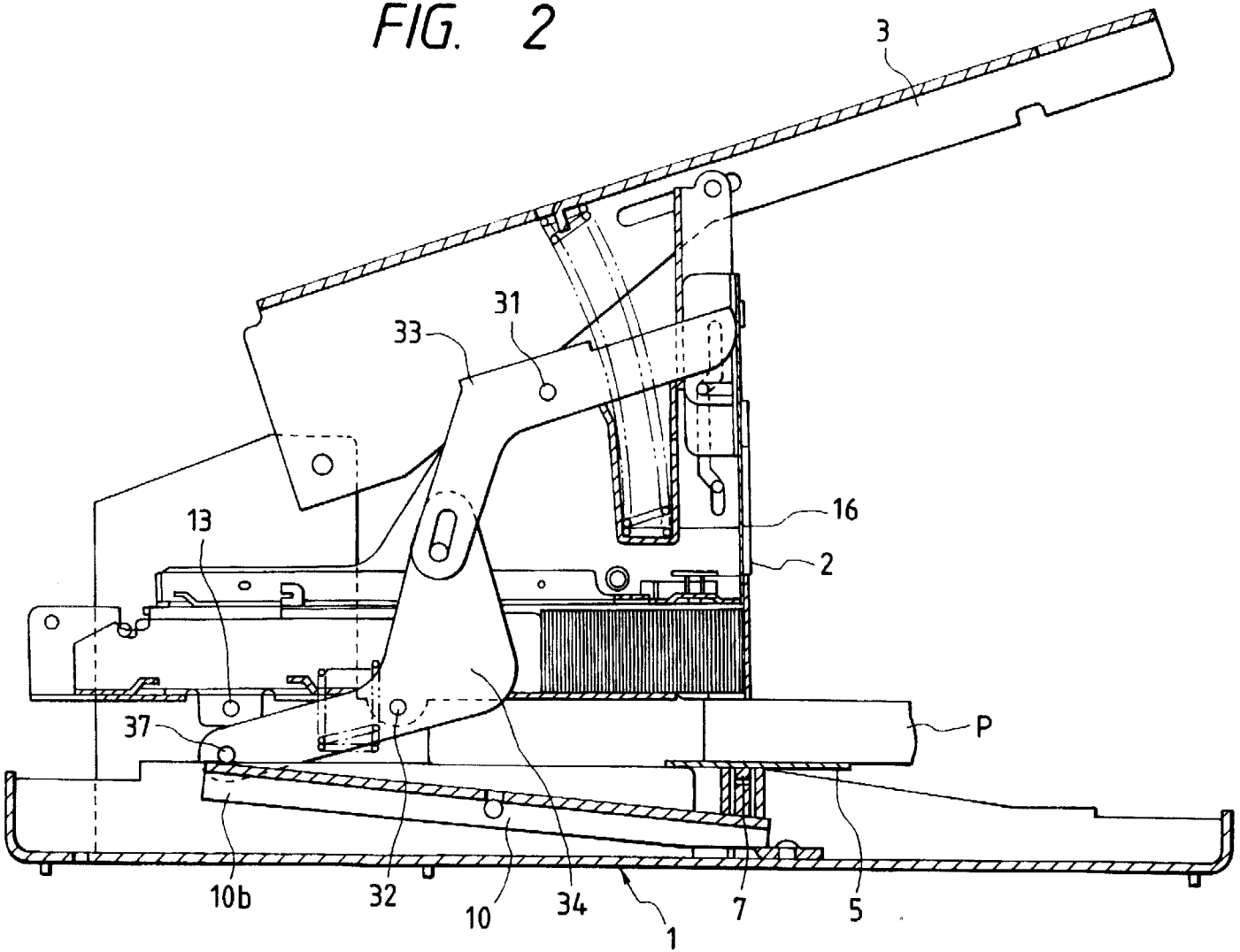
FIG. 2 is a diagram illustrative of a condition of the stapler in which a frame member is brought into contact with a thick pile of sheets.
Figure 3:
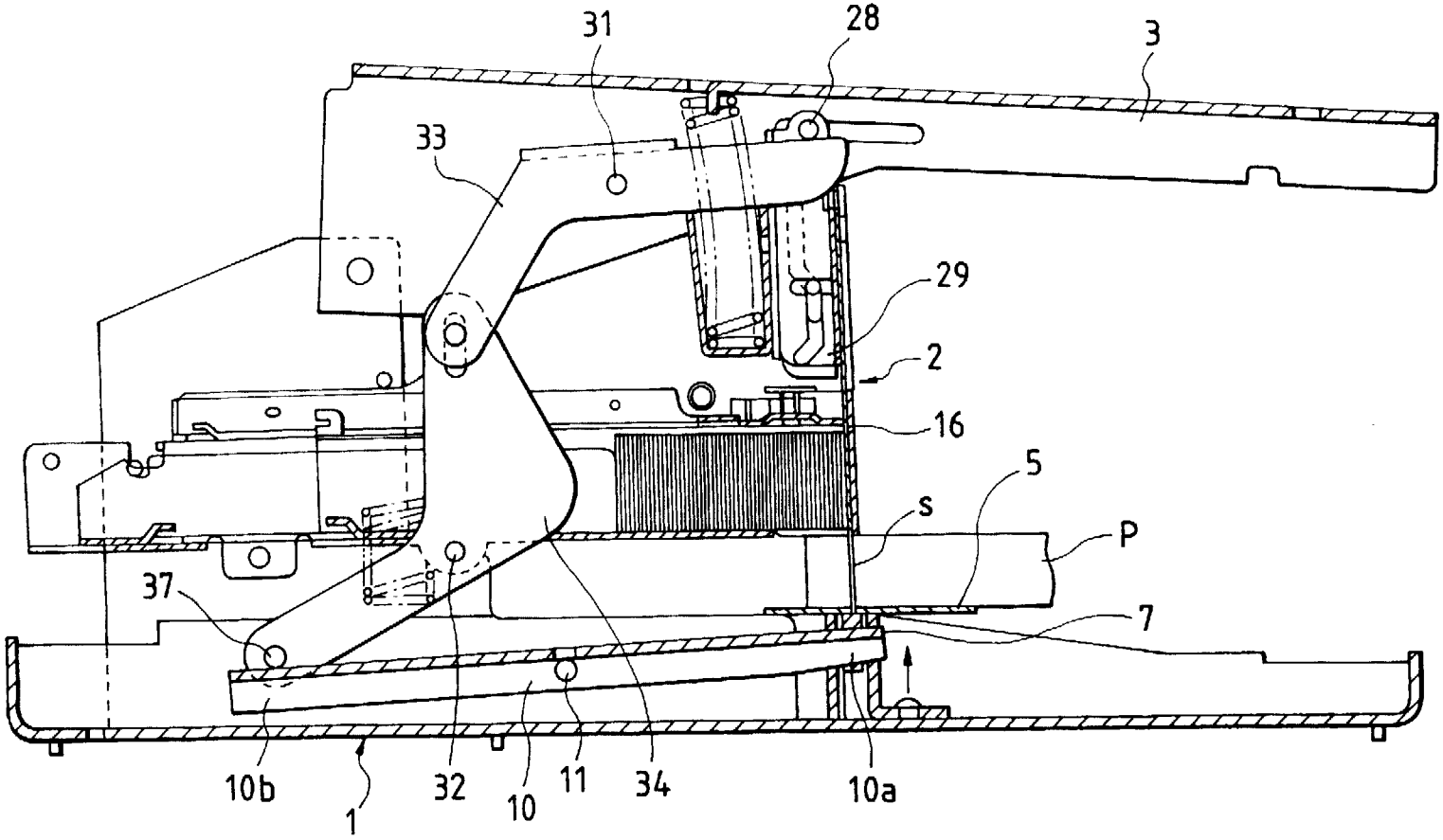
FIG. 3 is a diagram illustrative of an operation mode of a driver operating mechanism of the stapler.
Figures 7A, 7B, 7C, 7D, 7E:
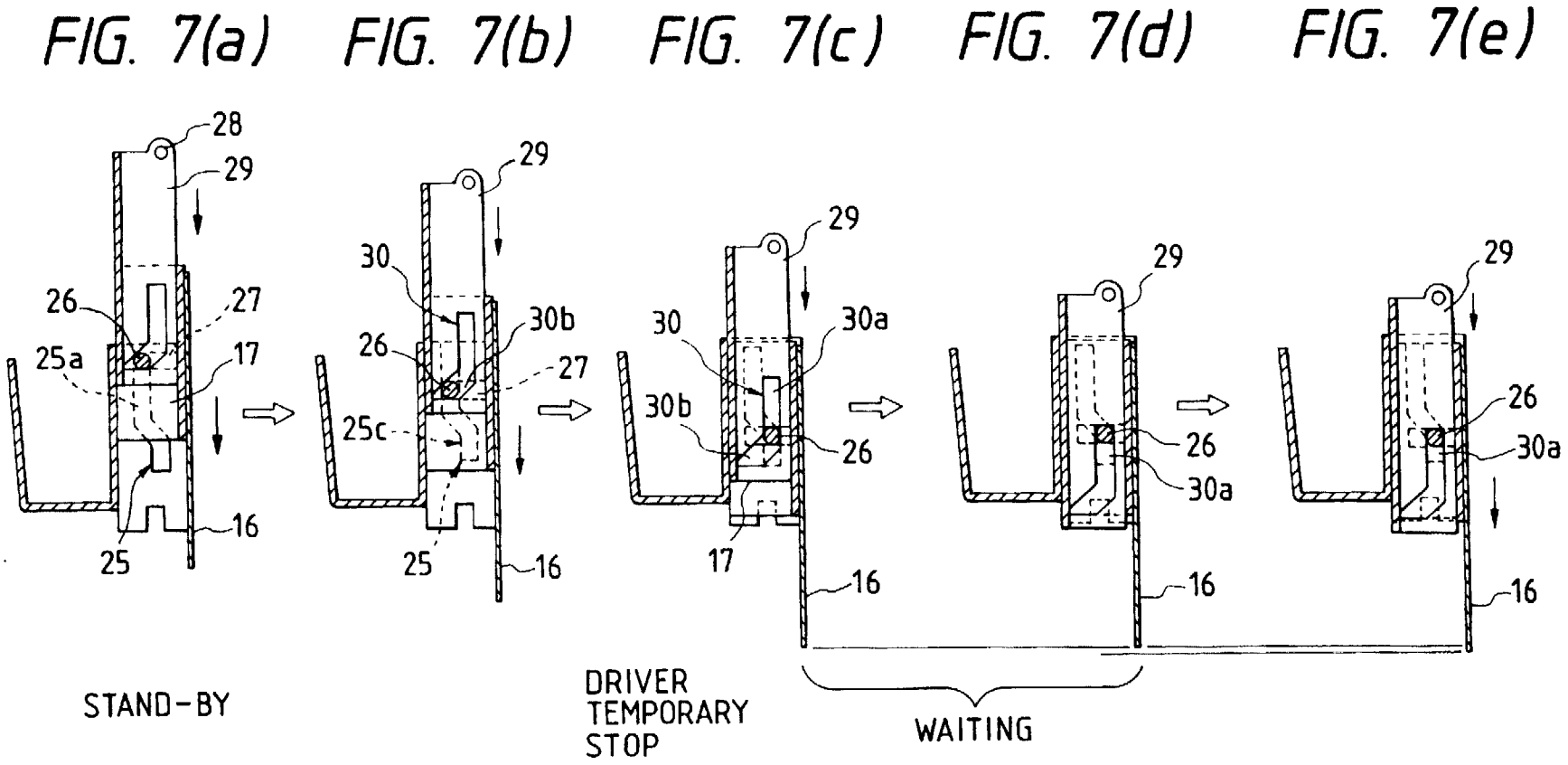
FIGS. 7(*a*), 7(*b*), 7(*c*), 7(*d*), and 7(*e*) are illustrative of an operation mode of the driver operating mechanism of the stapler.

According to the aforementioned mechanism, when the operating handle 3 is operated, both the operating handle 3 and the frame member 2 swing downward while keeping their relative positions as shown in FIG. 2 until the magazine unit 15 comes in contact with a pile of sheets P on the binding table 5 by means of resistance between the members. This turning of the operating handle 3 and the frame member 2 causes the first link 33 and the second link 34 to be displaced downward. However, the elongated hole 35 is formed to such a shape as to escape the shaft 36 so that the operating member 10 is prevented from pivoting by such downward displacement. That is, it is the elongated hole 35 that serves as a paper thickness adjusting mechanism. Thus, when the operating handle 3 is swung further as shown in FIG. 3 after the magazine unit 15 has come into contact with the pile of sheets P, the frame member 2 does not move but the operating means 29 moves downward. At this time, the operating pin 26 moves downward while guided by the upper groove portion 25*a* of the first guide groove 25 as shown in FIG. 7(*a*), and moves the driver holder 17 downward, allowing the legs of staples s to pierce the pile of sheets P. The pin 26 thus reaches the inclined groove portion 25*c* of the first guide groove 25 as shown in FIG. 7(*b*). When the operating pin 26 has reached the inclined groove portion 25*c* of the first guide groove 25, the inclined groove portion 25*c* crosses the inclined groove portion 30*b* of the third guide groove 30. As a result, the operating pin 26 moves rightward as viewed in FIG. 7(*b*) while guided by the inclined groove portion 25*c* of the first guide groove 25, the inclined groove portion 30*b* of the third guide groove 30, and the second guide groove 27. When the operating pin 26 has thereafter reached the moving end as shown in FIG. 7(*c*) to thereby engage with the longitudinal groove portion 30*a* of the third guide groove 30 of the operating means 29, the pin 26 escapes by moving along the longitudinal groove portion 30*a* even if the operating means 29 is moved downward. As a result, the driver holder 17 and the driver 16 remains stopped. It is not so that the driver holder 17 nearly reaches the bottom dead point thereof at this moment. The driver holder 17 and the driver 16 remain stopped until the operating pin 26 engages with the upper end of the longitudinal groove portion 30*a* immediately before reaching the bottom dead point of the operating handle 3, and both the operating pin 26 and the driver holder 17 are moved downward together with the operating means 29 by the resumed remaining downward movement of the operating handle 3 (see FIG. 7(*e*)).

When the operating handle 3 is moved downward this way, the driver 15 temporarily stops immediately before the driver holder 17 reaches the bottom dead point thereof as a result of the first half movement of the operating handle 3.

When the operating handle 3 is further moved downward thereafter, the engaging shaft 28 of the operating handle 3 engages with the end portion of the first link 33 of the link mechanism to thereby push such end portion downward during the latter half movement of the operating handle 3 as shown in FIG. 3. As a result, the first link 33 swings around the first rotary shaft 31 to thereby cause the second link 34 to turn about the turning shaft 32. In addition, the operating shaft 37 on the end of the second link 34 engages with the front end portion 10*b* of the operating member 10 of the base member 1 to thereby push the front end portion 10*b* downward. Hence, the operating member 10 swings around the shaft 11, causing the rear end 10*a* of the operating member 10 to push the movable clinchers 7 upward to turn. Thus, the legs of the staples s that have pierced the pile of sheets P are bent (see FIG. 5(*b*)).

Finally, the driver 15 moves to the bottom dead point thereof to press the staples s downward, so that reliable staple binding operation is ensured. The binding operation is thus completed. When the operating handle 3 is released after the binding operation has been completed, both the frame member 2 and the operating handle 3 are returned upward to their initial positions by the springs 14, 19.

As described in the foregoing, the binding operation can be performed without vertically moving the movable clincher 7 section including the support plates 6. Therefore, such inconvenience that a pile of sheets P rises in the middle will be eliminated.

The paper thickness adjusting mechanism is formed by setting the portion at which the operating shaft 37 on the end portion of the second link 34 engages with the front end 10*b* of the operating member 10 below the journal 13 that is the turning point of the frame member 2. As a result of this construction, a staple binding reaction from both the driver 16 and the clinchers 7 is received by both the journal 13 and the operating shaft 37 on a line that is substantially parallel to an operating line connecting the driver 16 and the clinchers 7. That is, the paper thickness adjusting mechanism is designed so that the pressing force derived from the operating handle 3 can be utilized for the staple binding operation most efficiently from the structural viewpoint.

As shown in FIGS. 1 and 2, the first rotary shaft 31 of the first link 33 and the second rotary shaft 32 of the second link 34 are arranged on the frame member 2. Since the inclination of the frame member 2 with respect to the base member 1 depends on the thickness of a pile of sheets P when the frame member 2 comes in contact with the surface of the pile of sheets P, the first rotary shaft 31 and the second rotary shaft 32 are positioned differently from one thickness of a pile of sheets P to another. If the first rotary shaft 31 and the second rotary shaft 32 are positioned differently, so is the operating shaft 37 of the second link 34. Therefore, the timing at which to operate the movable clinchers 7 loses synchronism, that causes defective binding operation.

Figure 4:
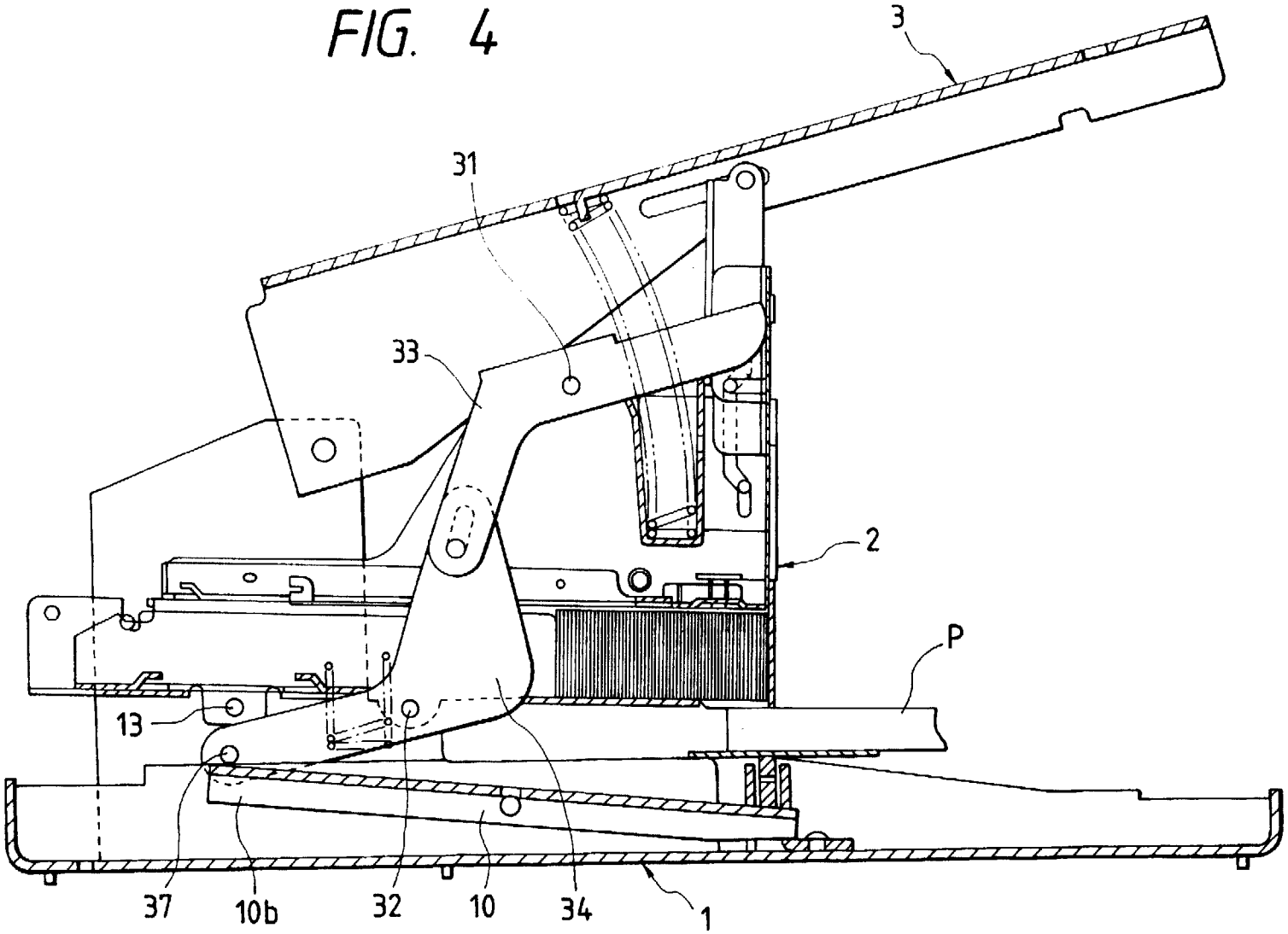
FIG. 4 is a diagram illustrative of a condition of the stapler in which the frame member is brought into contact with a thin pile of sheets.

However, the journal 13 of the frame member 2 never moves irrespective of the thickness of a pile of sheets P although a pile of sheets P shown in FIG. 4 is thinner than that shown in FIG. 2 as is apparent from a comparison between FIGS. 2 and 4. Since the portion at which the operating shaft 37 of the second link 34 engages with the front end 10*b* of the operating member 10 is arranged close to the journal 13 of the frame member 2, the aforementioned engaging position is little changed by the thickness of a pile of sheets P. As a result, the timing at which to operate the driver 16 and the movable clinchers 7 can be kept constant independently of the thickness of a pile of sheets P.

Figure 8:
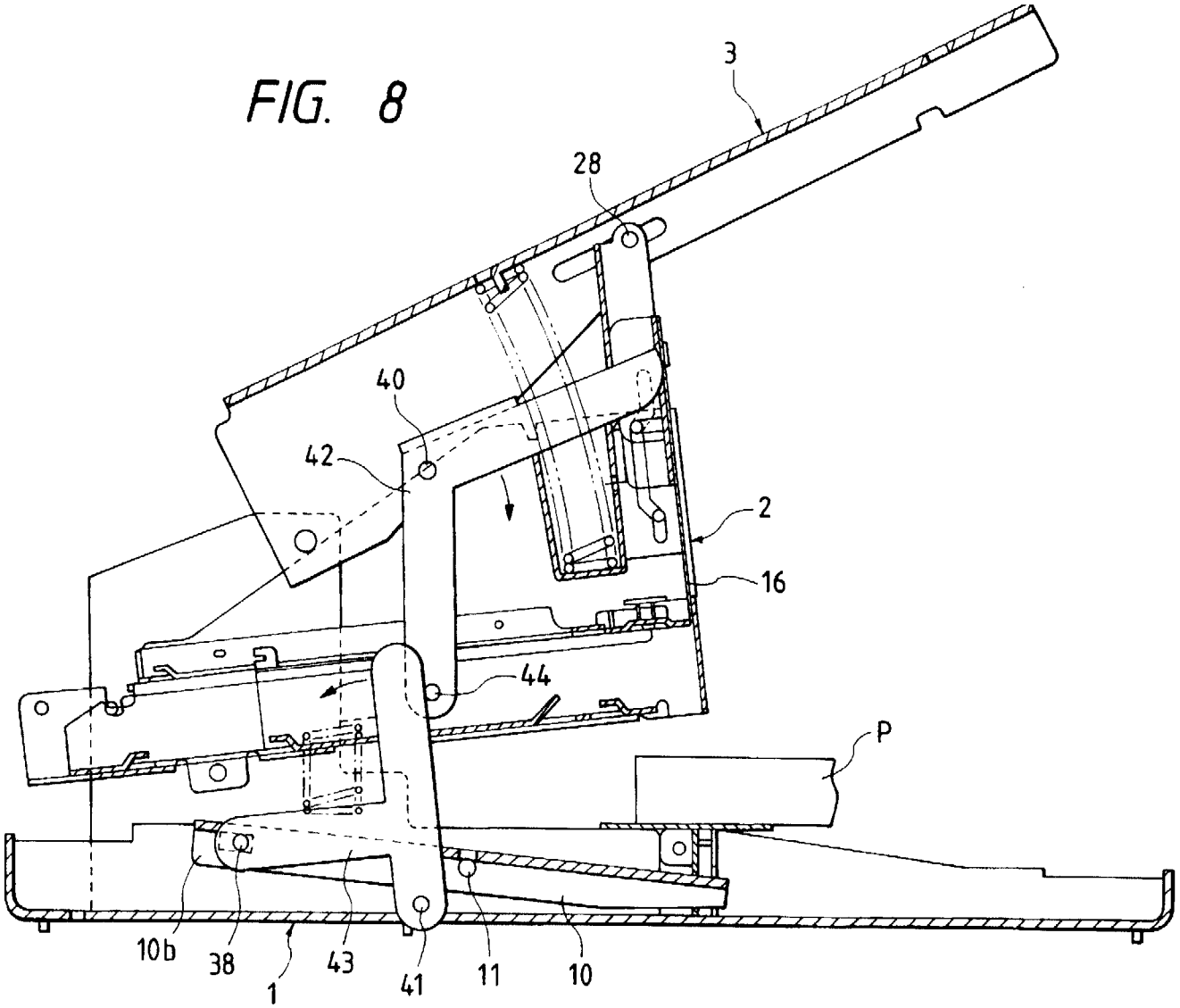
FIG. 8 is a sectional view showing another exemplary paper thickness adjusting mechanism of a stapler according to the invention.

FIG. 8 shows another exemplary paper thickness adjusting mechanism. The almost middle part of the operating member 10 is rotatably supported by the side walls of the base member 1 similarly to the aforementioned embodiment. Further, the link mechanism includes: a first link 42 supported by a first rotary shaft 40 arranged on a wall of the frame member 2 and a second link 43 supported by a second rotary shaft 41 arranged on the base member 1.

One end portion of the first link 42 is engageably arranged on the engaging shaft 28 of the operating handle 3, and an operating shaft 44 is arranged on the other end thereof. The operating shaft 44 engages with the upper rear end surface of the second link 43. The front portion of the second link 43 is coupled by a coupling shaft 38 to the front end 10*a* of the operating member 10 of the base member 1.

This embodiment is also designed so that the engaging shaft 28 of the operating handle 3 engages with the end portion of the first link 42 immediately before the driver 16 reaches the bottom dead point thereof.

According to the aforementioned construction, when the operating handle 3 is turned, the driver operating mechanism (the same as that of the aforementioned embodiment) is operated in the first half movement of the operating handle 3, and then the driver 16 similarly passes through a pile of sheets P and continues to be operated until the driver 16 nearly reaches the bottom dead point thereof although a description based on the drawings is omitted. Then, during the latter half movement of the operating handle 3, the engaging shaft 28 of the operating handle 3 engages with the end portion of the first link 42 of the link mechanism to thereby press such end portion downward, so that the first link 42 turns about the first rotary shaft 40, causing the operating shaft 44 to push the end surface of the second link 43 and to turn the second link 43 about the second rotary shaft 41. Further, the shaft 38 on the end portion of the second link 43 turns the operating member 10 about the shaft 11. Then, such end portion pushes the movable clinchers 7 upward to thereby turn the movable clinchers, so that the legs of the staples that have pierced the pile of sheets P are bent. Finally, the driver 16 moves to the bottom dead point thereof to thereby press the staples downward, so that reliable staple bending operation is ensured. The binding operation is thus completed.

Figure 9:
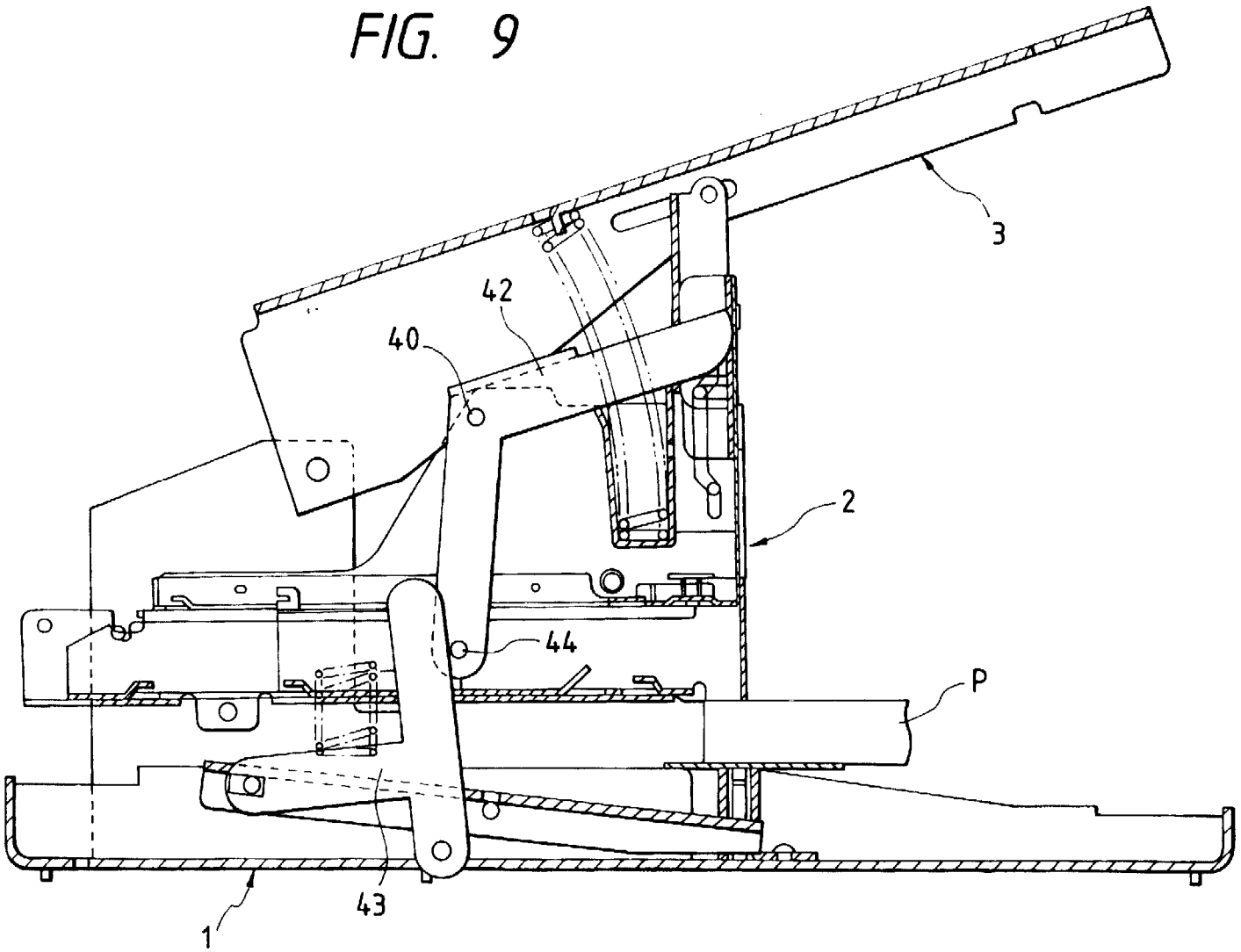
FIG. 9 is a sectional view illustrative of a condition of the stapler in which the frame member is brought into contact with a thick pile of sheets.
Figure 10:
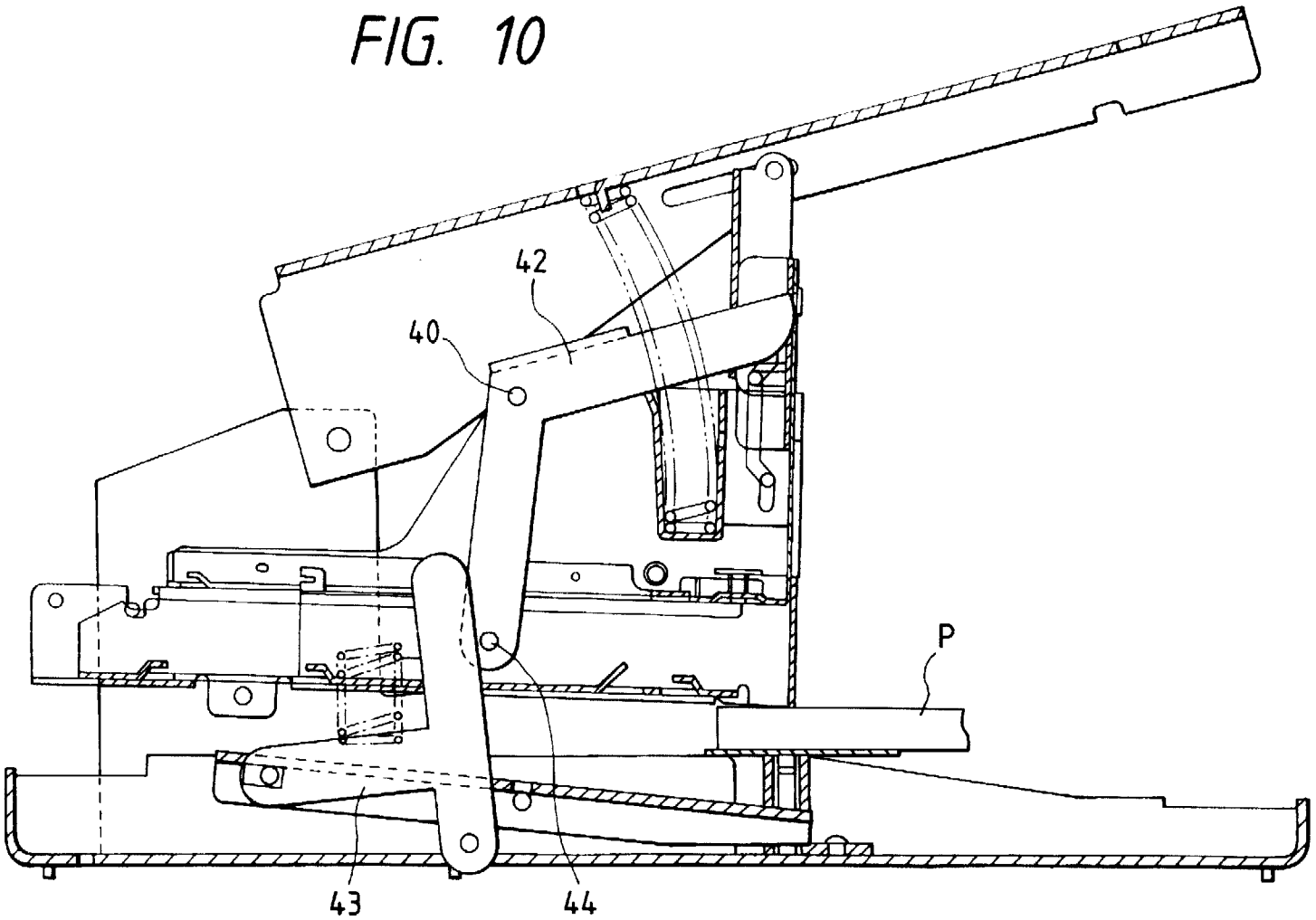
FIG. 10 is a sectional view illustrative of a condition of the stapler in which the frame member is brought into contact with a thin pile of sheets.

By the way, the first rotary shaft 40 of the first link 42 is arranged on the frame member 2. When the frame member 2 comes in contact with the surface of a pile of sheets P, the inclination of the frame member 2 with respect to the base member 1 depends on the thickness of a pile of sheets P. Therefore, as is apparent from a comparison between FIGS. 9 and 10, the first rotary shaft 40 is positioned with respect to the base member 1 differently from one thickness of a pile of sheets P to another. If the first rotary shaft 40 is positioned differently, the timing at which to operate the movable clinchers 7 loses synchronism.

Figure 11:
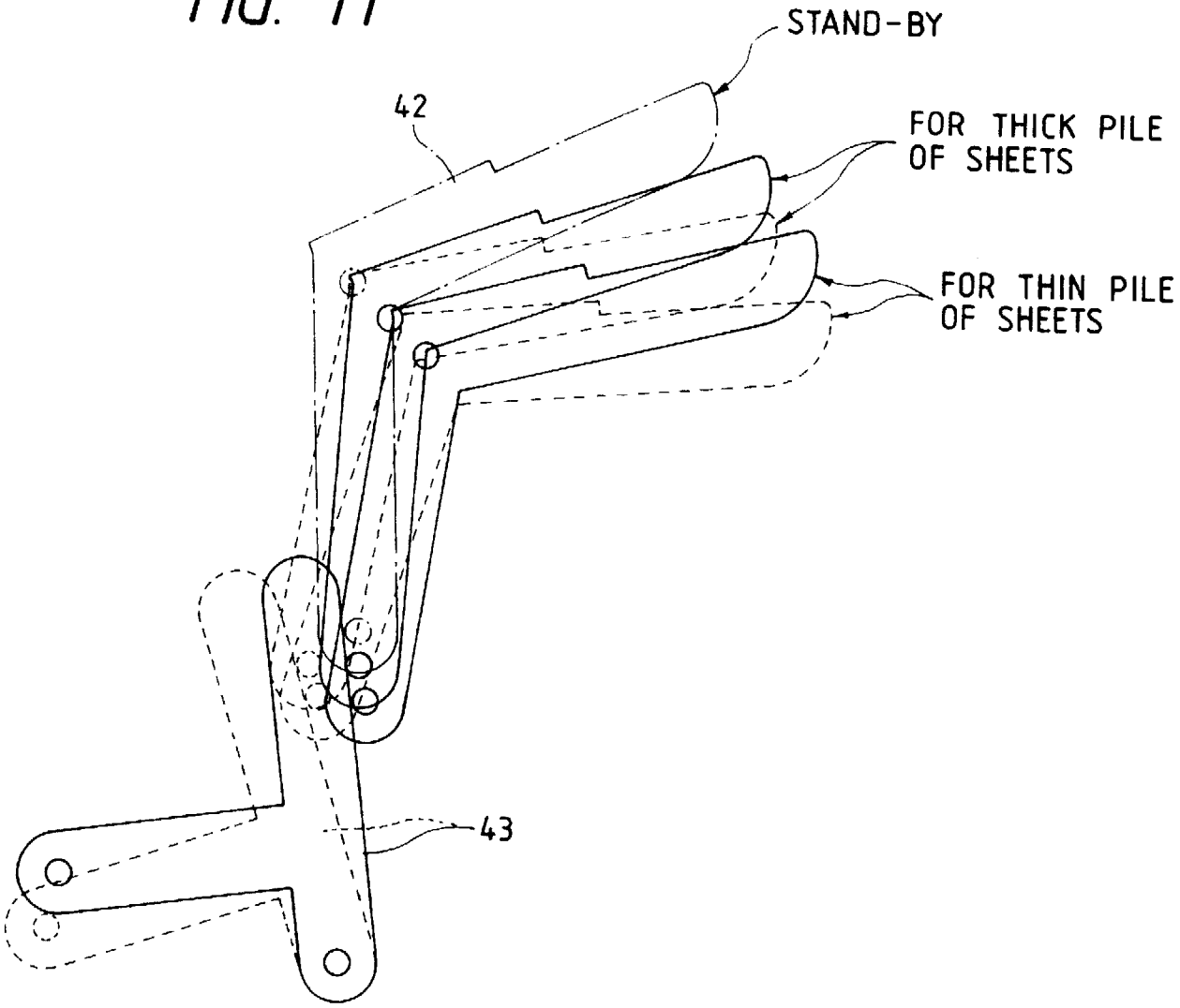
FIG. 11 is a diagram illustrative of operations of a link mechanism of the stapler for comparison between case of a thick pile of sheets and a case of a thin pile of sheets.

However, if the end surface of the second link 43 is formed so as to coincide with a locus of movement of the operating shaft 44 of the first link 42 depicted in associated with a change from a thick to a thin pile of sheets P, the paper thickness adjusting mechanism prevents the second link 43 from moving irrespective of the thickness of a pile of sheets P. Thus, as shown in FIG. 11, the operating member 10 can be operated at substantially the same timing based on the operations of the first link 42 and the second link 43 independently of the thickness of a pile of sheets P. As a result, satisfactory binding operation can be performed at all times.

Figure 12:
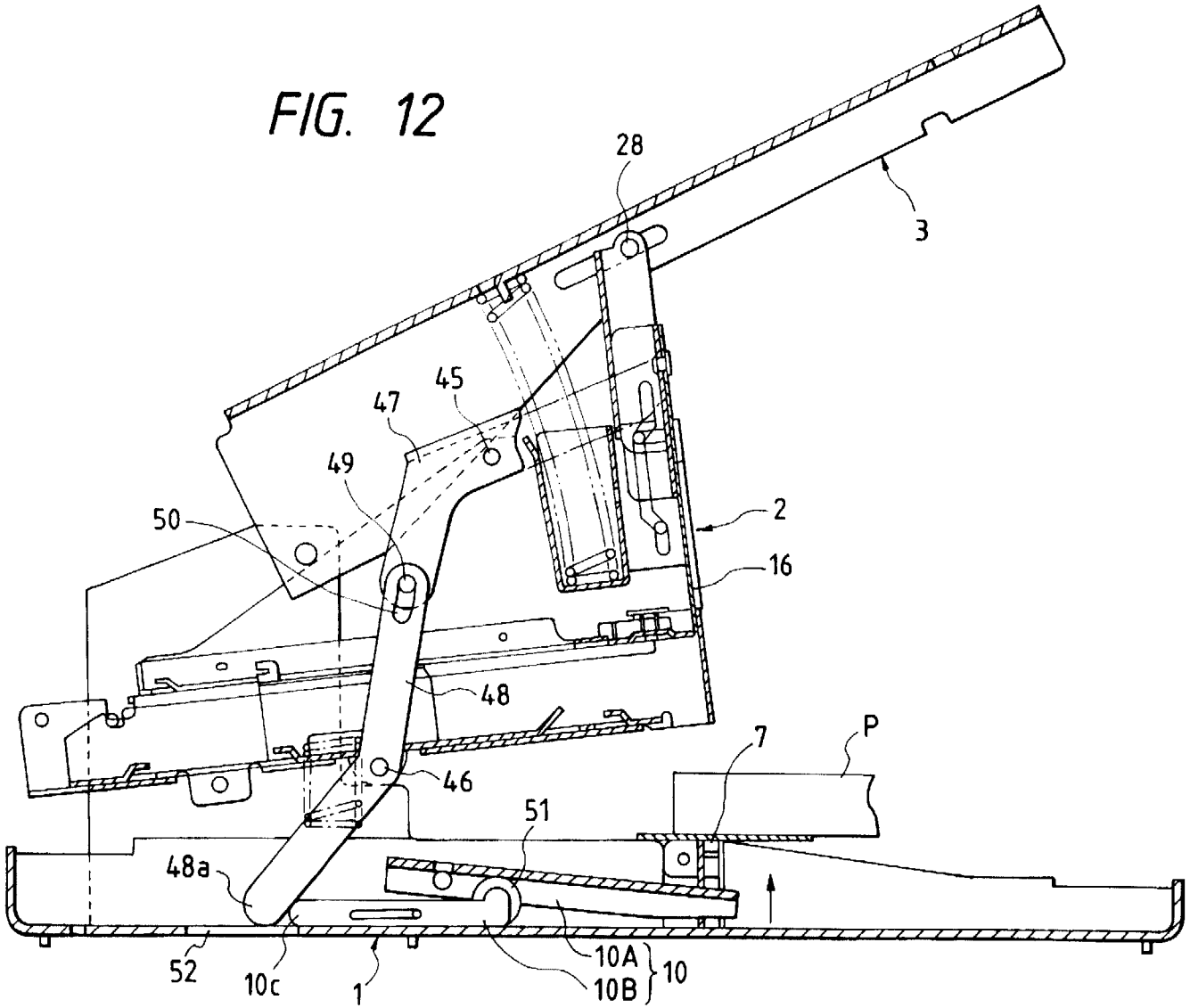
FIG. 12 is a sectional view showing still further exemplary paper thickness adjusting mechanism of the stapler.

FIG. 12 shows still other embodiments of an operating member 10 for the movable clinchers 7 and a link mechanism for driving the operating member 10. The operating member 10 includes: a first operating member 10A whose front portion is rotatably supported by a side wall of the base member 1; and a second operating member 10B that not only has a roller 51 rolling below the first operating member 10A but also is arranged so as to be horizontally slidable. Further, the link mechanism includes a first link 47 and a second link 48 that are respectively supported by a first rotary shaft 45 and a second rotary shaft 46 arranged on a side wall of the frame member 2. One end portion of the first link 47 is engageably arranged on the engaging shaft 28 of the operating handle 3. The first link 47 is coupled to the second link 48 by engaging a shaft 49 with an elongated hole 50. An end portion 48*a* of the second link 48 engages with a front end portion 10*c* of the second operating member 10B of the base member 1. When the operating handle 3 is moved downward, not only the shaft 49 of the first link 47 is moved along the elongated hole 50 of the second link 48, but also the end portion 48*a* is moved along the front end portion 10*c* of the operating member 10 when the second link 48 inclines. It may be noted that the second link 48 is formed so as to escape downward from an opening portion 52 in the bottom of the base member 1.

According to the aforementioned construction, when the operating handle 3 is turned, the driver operating mechanism (the same as that of the aforementioned embodiment shown in FIG. 1) is operated in the first half movement of the operating handle 3, and then the driver 16 similarly passes through a pile of sheets P and continues to be operated until the driver 16 nearly reaches the bottom dead point thereof although a description based on the drawings is omitted. Then, during the latter half movement of the operating handle 3, the engaging shaft 28 of the operating handle 3 engages with the end portion of the first link 47 of the link mechanism to thereby press such end portion downward, so that the first link 47 turns clockwise, which turns the second link 48 counterclockwise to thereby move the second operating member 10B frontward. In addition, the roller 51 on the end of the second operating member 10B turns the first operating member 10A, whose end then turns the movable clinchers 7. As a result, the legs of staples that have pierced the pile of sheets P are bent. Finally, the driver 16 reaches the bottom dead point thereof to thereby push the staples downward, so that reliable staple bending operation is ensured. The binding operation is thus completed.

Figure 13:
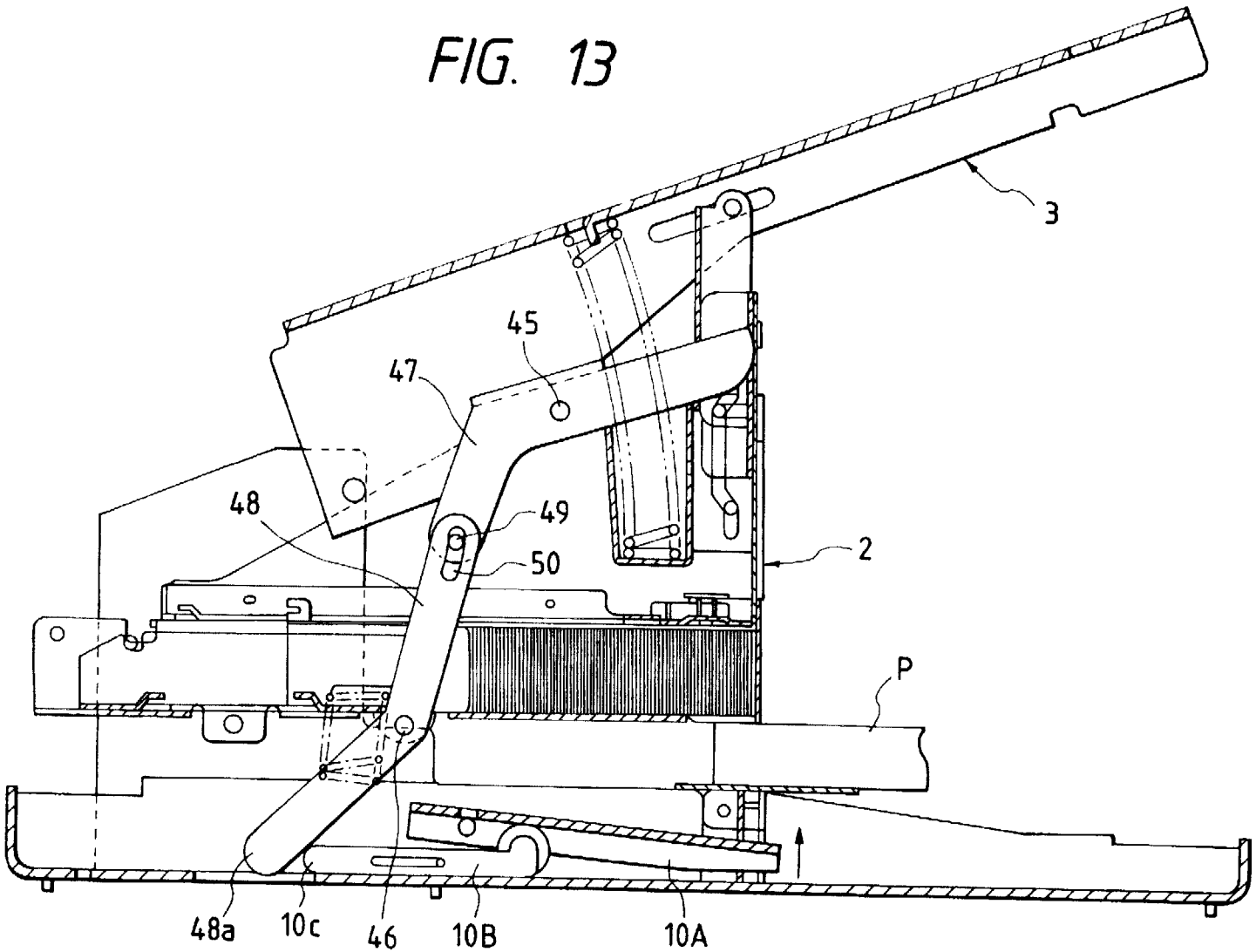
FIG. 13 is a sectional view illustrative of a condition of the stapler in which the frame member is brought into contact with a thick pile of sheets.
Figure 14:
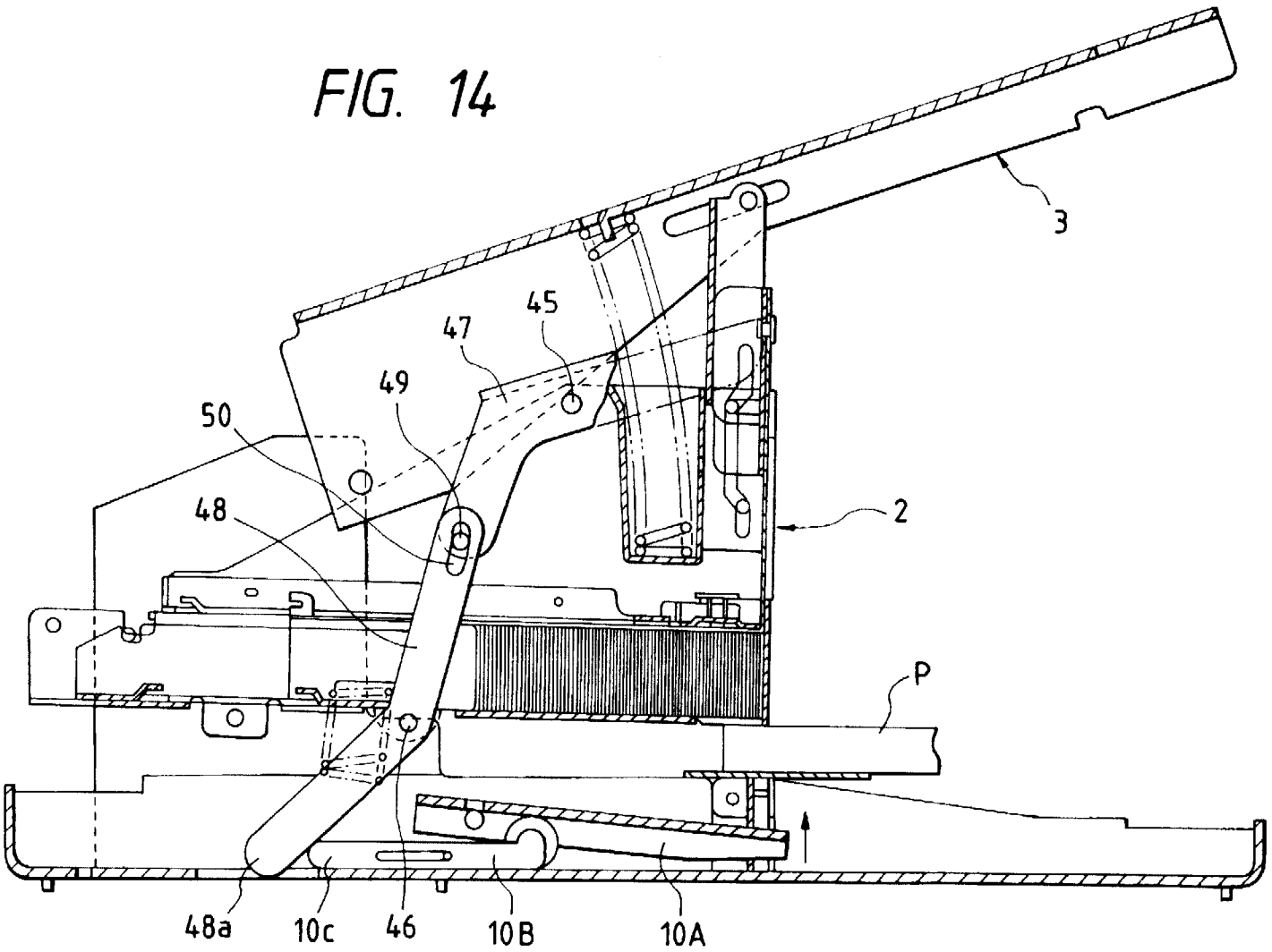
FIG. 14 is a sectional view illustrative of a condition of the stapler in which the frame member is brought into contact with a thin pile of sheets.

Since the first rotary shaft 45 and the second rotary shaft 46 are positioned differently from one thickness of a pile of sheets P to another, the link mechanism is also displaced. However, as is apparent from a comparison between FIGS. 13 and 14, it is so designed that not only the shaft 49 of the first link 47 moves along the elongated hole 50 of the second link 48, but also the bottom surface of the second link 48 slides along the front end portion 10*c* of the second operating member 10B when the second link 48 inclines, so that the condition in which the end portion 48*a* of the second link 48 is in contact with the front end portion 10*c* of the second operating member 10B can be held. Therefore, the operating member 10 can be operated at substantially the same timing irrespective of the thickness of a pile of sheets P.

Figure 15:
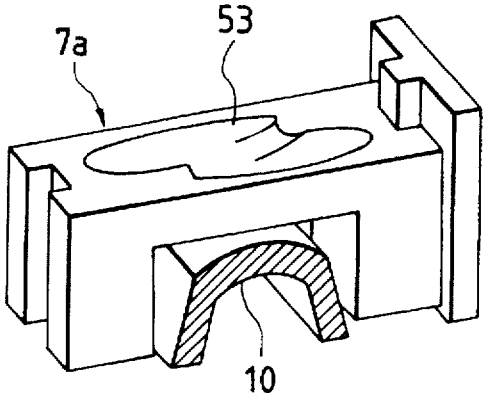
FIG. 15 is a perspective view of another exemplary movable clincher of the stapler.

It may be noted that the construction of a movable clincher is not limited to the pair of movable clinchers as disclosed above. For example, as a movable clincher 7*a* shown in FIG. 15, a clincher groove 53 may be formed in the upper surface so that the movable clincher is arranged so as to be vertically movable, and such movable clincher 7*a* may be moved vertically by an operating member 10 of the same construction as described above.

Figure 16:
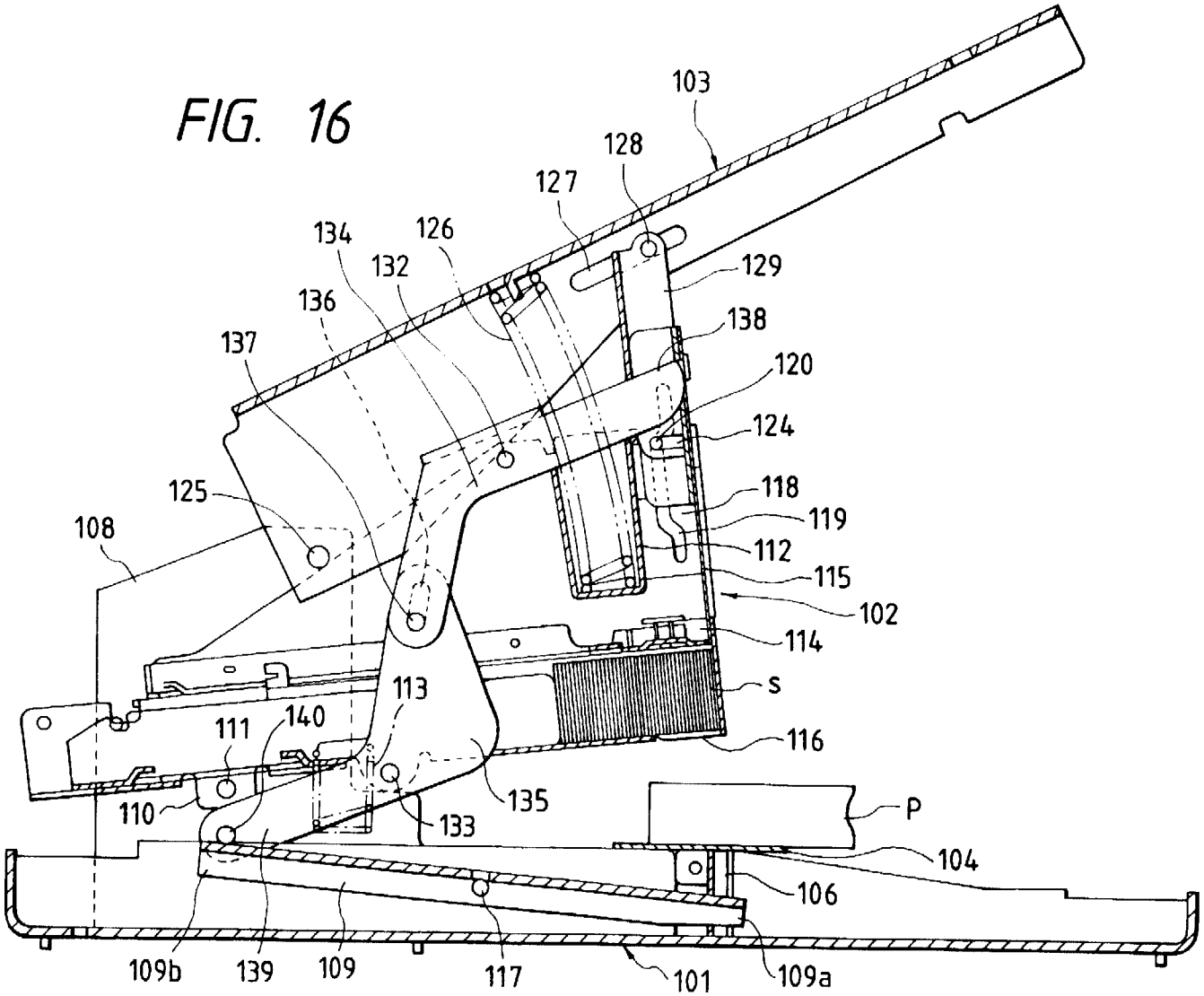
FIG. 16 is a diagram showing another stapler of the invention in sectional form.

FIG. 16 shows another stapler of such a type as to be used while placed on a desk. In FIG. 16, reference numeral 101 denotes a base member; 102, a frame member; and 103, an operating handle.

A binding table 104 is formed on the upper and almost middle part of the base member 101. A pair of movable clinchers 106 are arranged on support plates 5 so as to be rotatable about shafts 107, respectively (see FIG. 18). The support plates 105 are located below the binding table 104. Rising walls 108 are formed on both front sides of the base member 101 so as to project from the base member 101.

Supporting pieces 110 project downward from both front sides of the frame member 102. These supporting pieces 110 are not only supported by a journal 111 so that the frame member 102 can swing with respect to the base member 101, but also urged so that the frame member 102 can swing upward at all times with a spring 113. In addition, inside the frame member 102 is a magazine unit 114. The magazine unit 114 is so formed as to accommodate staples s therein. It may be noted that a hammering opening 116 is formed so as to pass through the upper and lower portions on the rear end of the magazine unit 114. The hammering opening is designed to allow the driver 115 and the forefront staple s to be hammered out.

Figure 19:
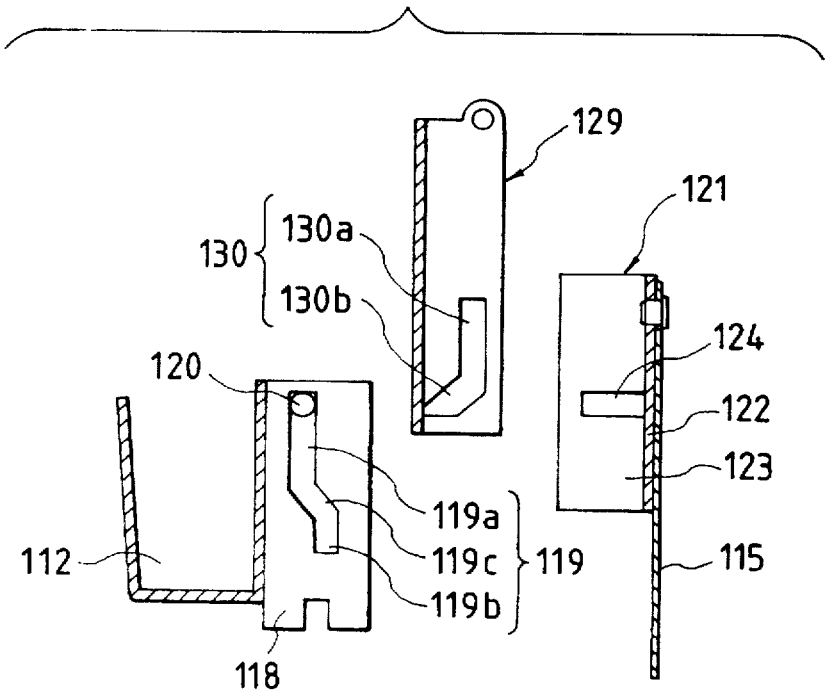
FIG. 19 is an exploded diagram of a driver operating mechanism of the stapler.

On the rear portion of the frame member 102 is a spring shoe 112 for receiving a spring 126. A wall 118 that is square C-shaped in cross section is integrally formed on the front portion of the spring shoe 112. The wall 118 serves to form a sliding groove. As shown in FIG. 19, the square C-shaped wall 118 has a first guide groove 119 which vertically extends in form of Z-shape. The first guide groove 119 has an upper groove portion 119*a* and a lower groove portion 119*b* coupled through an inclined groove portion 119*c*. An operation pin 120 is slidably engaged with the first guide groove 119.

Further, the driver holder 121 is guided and held by the sliding groove in the front end of the frame member 102 so as to be vertically slidable. The driver holder 121 is square C-shaped in cross section, holds the driver 115 in a middle piece 122 thereof, and has a second guide groove 124 which horizontally extends straight in a side piece 123 thereof. The operating pin 120 is slidably engaged also with the second guide groove 124.

The operating handle 103 is supported by a journal 125 so that the operating handle 103 can rotate with respect to the base member 101. The journal 125 passes through the rising walls 108 of the base member 101. The operating handle 103 is also urged by the spring 126 so that the operating handle 103 can swing upward with respect to the frame member 102 at all times. Further, an elongated hole 127 is formed in a side wall of the middle part of the operating handle 103, and an operating means 179 of the driver 115 is coupled to a shaft 128 that is engaged with the elongated hole 127. The operating means 129 is also square C-shaped in cross section, and is held by the sliding groove of the frame member 102 so as to be vertically slidable. As shown in FIG. 19, a third guide groove 30 is in form of J-shape in a side piece of the operating means 129. The third guide groove 130 has a longitudinal groove portion 130*a* vertically extending an inclined groove portion 130*b* formed continuously. The operating pin 120 is slidably engaged also with the third guide groove 130.

Figure 17:
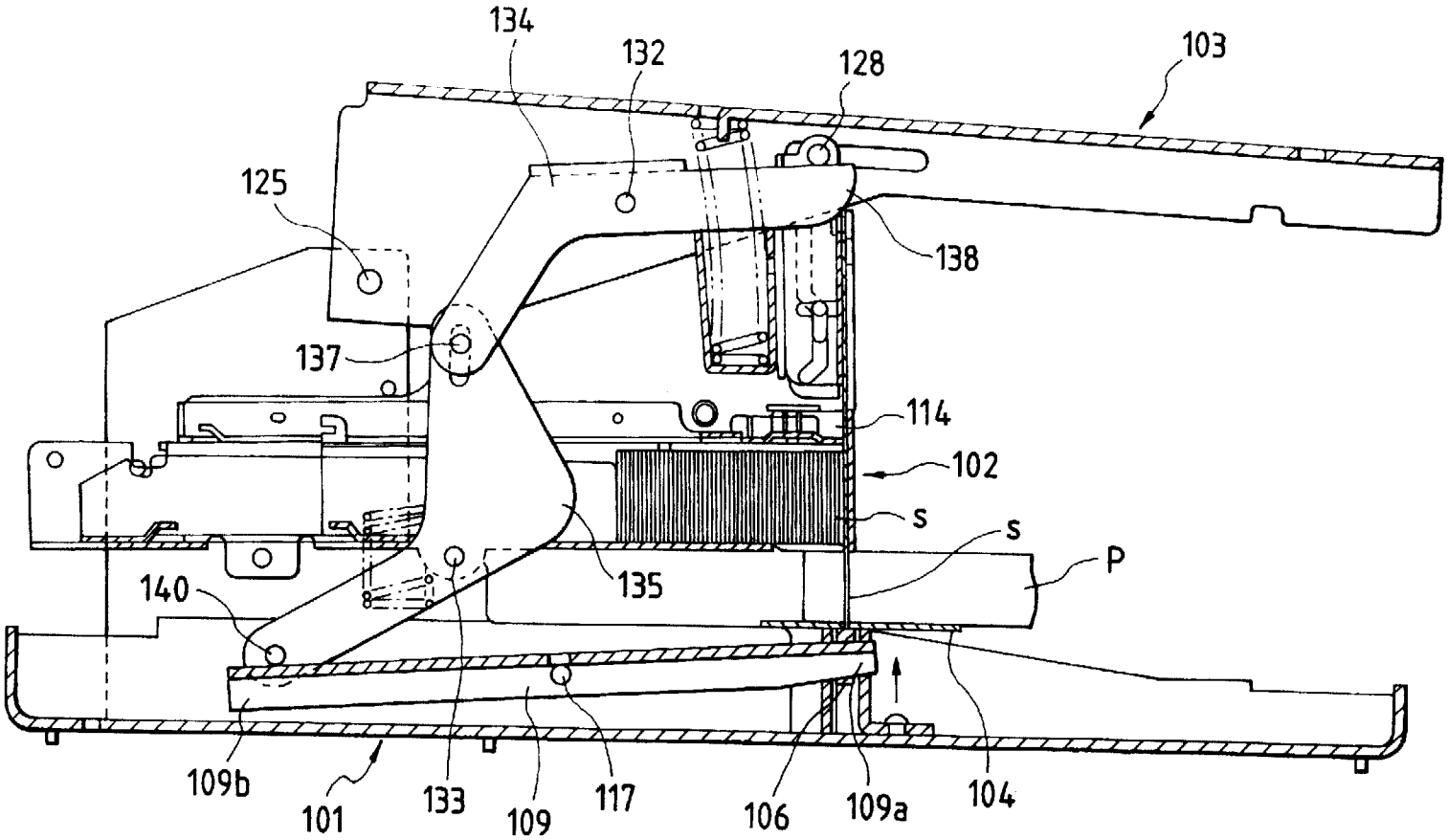
FIG. 17 is a diagram illustrative of how the stapler performs binding operation.
Figures 20A, 20B, 20C, 20D, 20E:
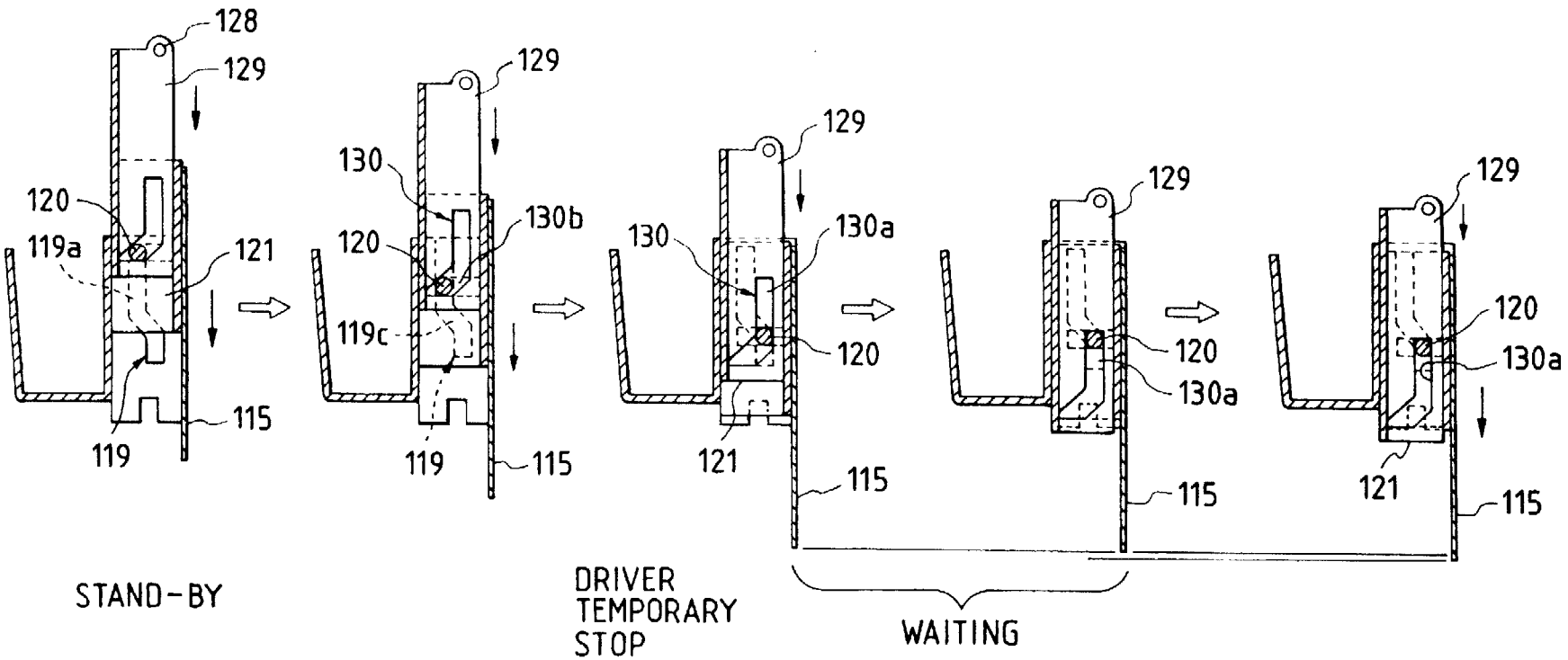
FIGS. 20(*a*), 20(*b*), 20(*c*), 20(*d*), and 20(*e*) are illustrative of how the driver operating mechanism of the stapler is operated.

According to the aforementioned construction, when the operating handle 103 is turned as shown in FIG. 17, the frame member 102 does not move after the magazine unit 114 has come in contact with a pile of sheets P, but the operating means 129 moves downward. Since the operating pin 120 moves downward while guided by the upper groove portion 119*a* of the first guide groove 119 as shown in FIG. 20(*a*) at this time, the driver holder 121 also moves downward, causing the driver 115 to allow the legs of staples s to pierce the pile of sheets P. Then, the operating pin 120 reaches the inclined groove portion 119*c* of the first guide groove 119. When the operating pin 120 has reached the inclined groove portion 119*c* of the first guide groove 119, the inclined groove portion 119*c* crosses the inclined groove portion 130*b* of the third guide groove 130. Therefore, the operating pin 120 moves rightward as viewed in FIG. 20(*b*) while guided by the inclined groove portion 119*c*, the inclined groove portion 130*b*, and second guide groove 124 as shown in FIG. 20(*b*). Then, when the operating pin 120 has reached the moving end as shown in FIG. 20(*c*) to thereby engage with the longitudinal groove portion 130*a* of the third guide groove 130 of the operating means 129, the driver 115 remains stopped since the operating pin 120 moves and escapes along the longitudinal groove portion 130*a* from the downward movement of the operating means 129 even if the operating means 129 is moved downward as shown in FIG. 20(*d*). The driver holder 121 is set so as to nearly reach the bottom dead point thereof at this time. Then, as shown in FIG. 20(*e*), the operating pin 120 engages with the upper end of the upper groove portion immediately before reaching the bottom dead point of the operating handle 103, and both the operating pin 120 and the driver holder 121 are moved downward together with the operating means 129 by the resumed remaining downward movement of the operating handle 103.

As described above, the driver holder 121 is controlled so that the driver holder 121 temporarily stops immediately before the driver holder 121 reaches the bottom dead point thereof when the operating handle 103 is moved downward, and the drive holder 121 is further controlled so that the driver holder 121 resumes the downward movement immediately before the moving end of the operating handle 103 when the operating handle 103 is further moved downward.

Hence, the movable clincher 106 operating mechanism may be set so that the movable clincher 106 operating mechanism is operated while interlocking with the downward movement of the operating handle 103 during the stoppage of the driver holder 121. That is, when the driver holder 121 is in the condition shown in FIG. 20(*c*), i.e., the condition immediately before the driver holder 121 reaches the bottom dead point thereof, it is so set that the operating handle 3 activates the movable clincher operating mechanism and terminates the movable clincher operating mechanism between the condition shown in FIG. 20(*c*) and that shown in FIG. 20(*d*).

The movable clincher operating mechanism may be formed of an operating member and a link mechanism such as shown in FIGS. 16 and 17, for example.

The middle part of the operating member 109 is rotatably disposed on a shaft 117 arranged on the side wall of the base member 101. One end 109*a* of the operating member 109 is arranged below the movable clinchers 106 and the other end is arranged so as to interlock with the movement of the operating handle 103. The link mechanism includes: a first link 134 and a second link 135 that are arranged on a side wall of the frame member 102. The first link 134 is supported by a first rotary shaft 132 and the second link 135 is supported by a second rotary shaft 133. An elongated hole 136 is formed in one end of the second link 135, and a shaft 137 arranged on one end of the first link 134 is engaged with the elongated hole 136, so that both links 134, 135 are coupled to each other. Further, an end portion 138 of the first link 134 is arranged so as to be engageable with a lower portion of the operating handle 103. A shaft 140 is arranged on an end portion 139 of the second link 135. The shaft 140 is arranged so as to be engageable with an upper portion of the end portion 109*b* of the operating member 109. The link mechanism is also designed so that the end portion 138 of the first link 134 engages with the engaging shaft 128 of the operating handle 103 immediately before the driver 119 reaches the bottom dead point thereof and at the same time that the end portion 139 of the second link 135 engages with the end portion 109*b* of the operating member 109.

Figure 18A:
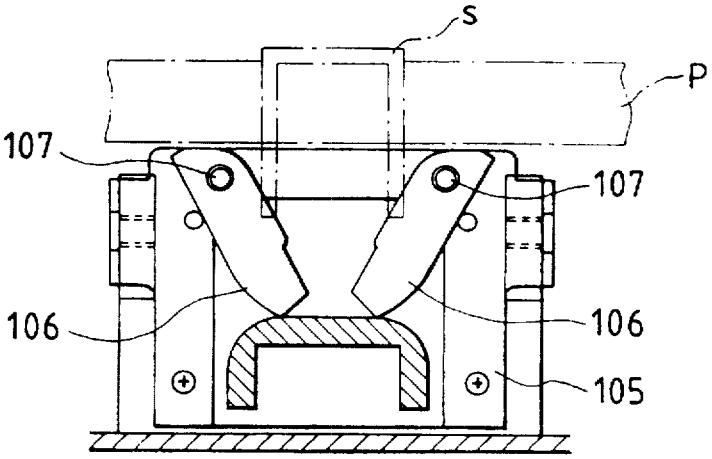
FIGS. 18(*a*) and 18(*b*) are illustrative of how a movable clincher of the stapler is opened and closed.
Figure 18B:
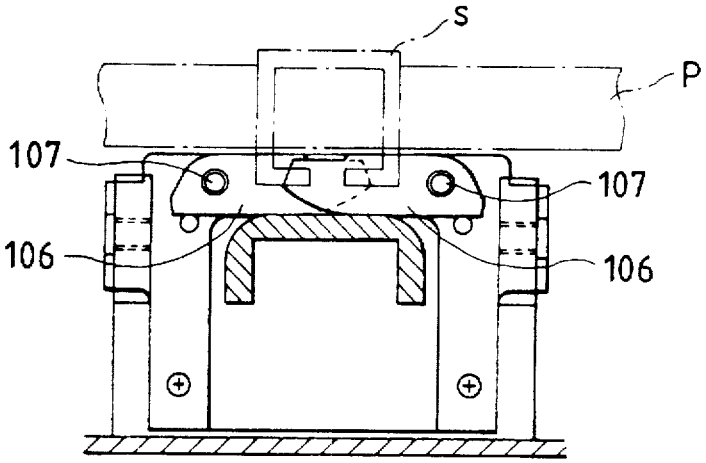

Therefore, when the operating handle 103 is further moved downward with the driver 115 being in stand-by position as described above, the engaging shaft 128 of the operating handle 103 engages with the end portion 138 of the first link 134 of the link mechanism to thereby push such end portion 138 downward as shown in FIG. 17. Therefore, the first link 134 turns about the first rotary shaft 132 to thereby turn the second link 135 about the second rotary shaft 133. Further, since the shaft 140 on the end portion of the second link 135 engages with the end portion 109*b* of the operating member 109 of the base member 101 to thereby push such end portion 109*b* downward, the operating member 109 is turned, which in turn causes the end portion 109*a* of the operating member 109 to push the movable clinchers 106 upward and allows the movable clinchers 106 to rotate about the journals 107 as shown in FIG. 18(*b*). As a result, the legs of the staples s that have pierced the pile of sheets P are bent.

When the operating handle 103 is moved further downward after the legs of the staples have been bent, the driver holder 121 moves to the bottom dead point thereof together with the operating means 129, so that the driver 115 is pushed onto the pile of sheets P strongly, allowing the legs of the staples s to be more reliably bent. The binding operation is thus completed. When the operating handle 103 is released after the binding operation has been completed, both the operating handle 103 and the frame member 102 are moved upward by the springs. The operating pin 120 is also moved upward after having moved rearward in a manner opposite to the aforementioned process, and also the driver holder 121 returns to the initial position thereof.

Figure 21:
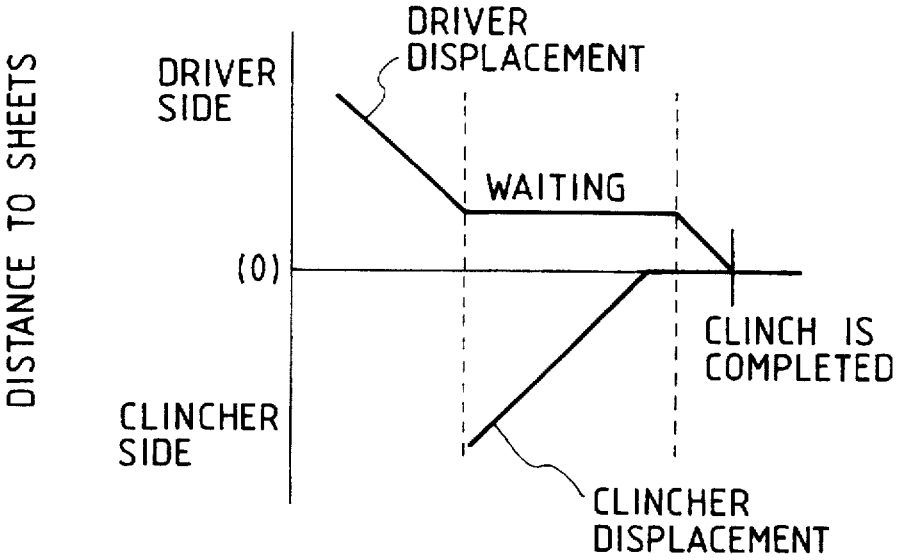
FIG. 21 is a graph showing the operating timing of the driver and that of the movable clincher.

The thus constructed driver temporary stopping mechanism is characterized as temporarily stopping the operation of the driver 115 immediately before the driver 115 reaches the bottom dead point thereof by controlling the movement of the driver holder 121 with the operating pin 120 so as to interlock with the movement of the operating handle 103, the operating pin 120 being guided by the respective grooves of the operating means 129 of the operating handle 103, the driver holder 121, and the square C-shaped wall 118. Therefore, the operating mechanism of the movable clinchers 106 can be interlocked with the downward movement of the operating handle 103 during such temporary stoppage. Therefore, the timings at which to displace the driver and the movable clinchers are such as shown in FIG. 21, which means that the operation of piercing and bending the staples can be performed at optimal timings.

The operating means 129 is not limited to such construction that the operating means 129 is coupled to the operating handle 103. The operating means 129 may be integrally formed with the operating handle 103. However, the latter construction requires that the third guide groove 130 be shaped differently.

Figure 22:
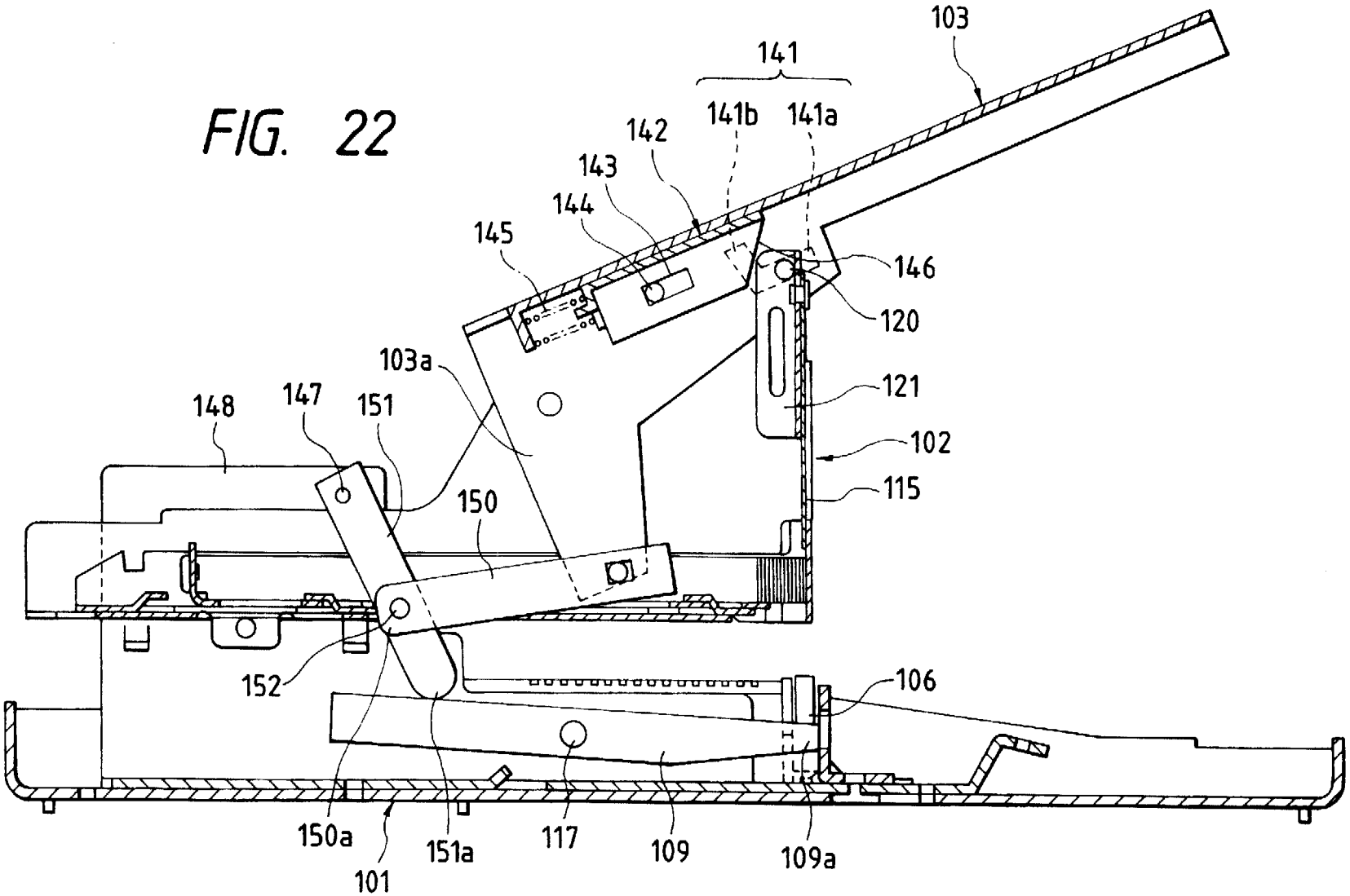
FIG. 22 is a diagram illustrative of another exemplary driver temporarily stopping mechanism.

FIG. 22 shows another exemplary driver temporary stopping mechanism. This is an embodiment in which a guide groove 141 is formed in the operating handle 103, and the operating pin 120 arranged on the driver holder 121 is engaged with the guide groove 141, so that the movement of the driver 115 is controlled by the operating pin 120 guided by the guide groove 141 so as to interlock with the movement of the operating handle 103.

The guide groove 141 is formed on each of both side walls of the operating handle 103, and includes a horizontally extending groove 141*a* that is formed along the length and a vertically extending groove 141*b* that is continuous to the horizontally extending groove 141*a* so as to be substantially at right angles thereto.

The operating handle 103 has a square C-shaped press member 142 arranged so as to be slidable along the length thereof. The press member 142 has an elongated hole 143 formed on a side wall, and the elongated hole 143 engages with a shaft 144 fixed to the operating handle 103. Further, the press member 142 is urged by a spring 145 so that an inclined front end surface 146 thereof engages with the operating pin 120 to thereby press the operating pin 120 when the operating handle 103 is moved downward.

An operating mechanism, which will be described later and which is the same as the one described above, is arranged on the base member 101. That is, the operating mechanism drives the movable clinchers 106 to turn by operating the operating member 109 during the downward movement of the operating handle 103.

Figure 23:
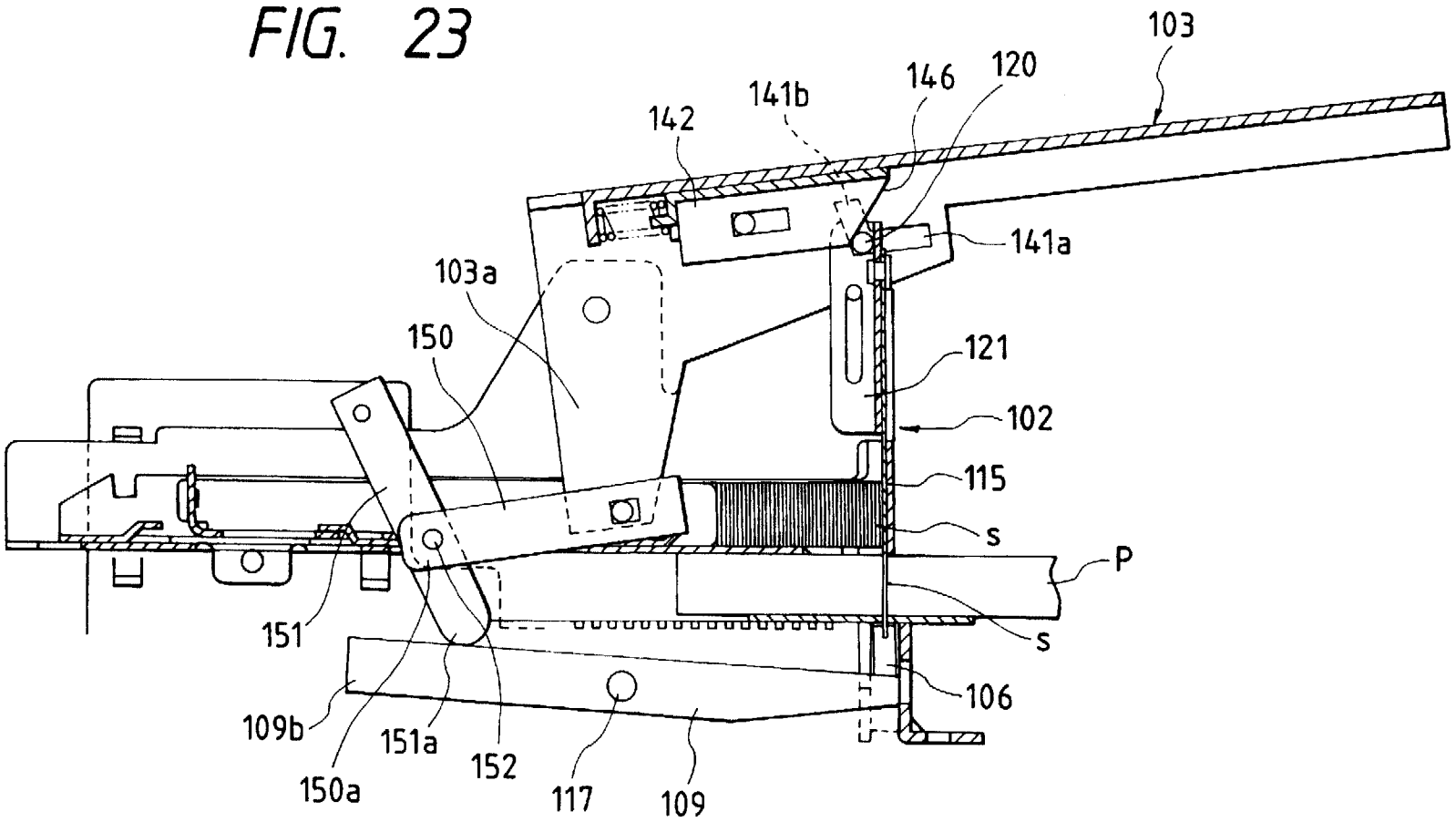
FIG. 23 is a diagram illustrative of the driver that is in stoppage in the driver temporary stopping mechanism of the stapler.
Figure 24:
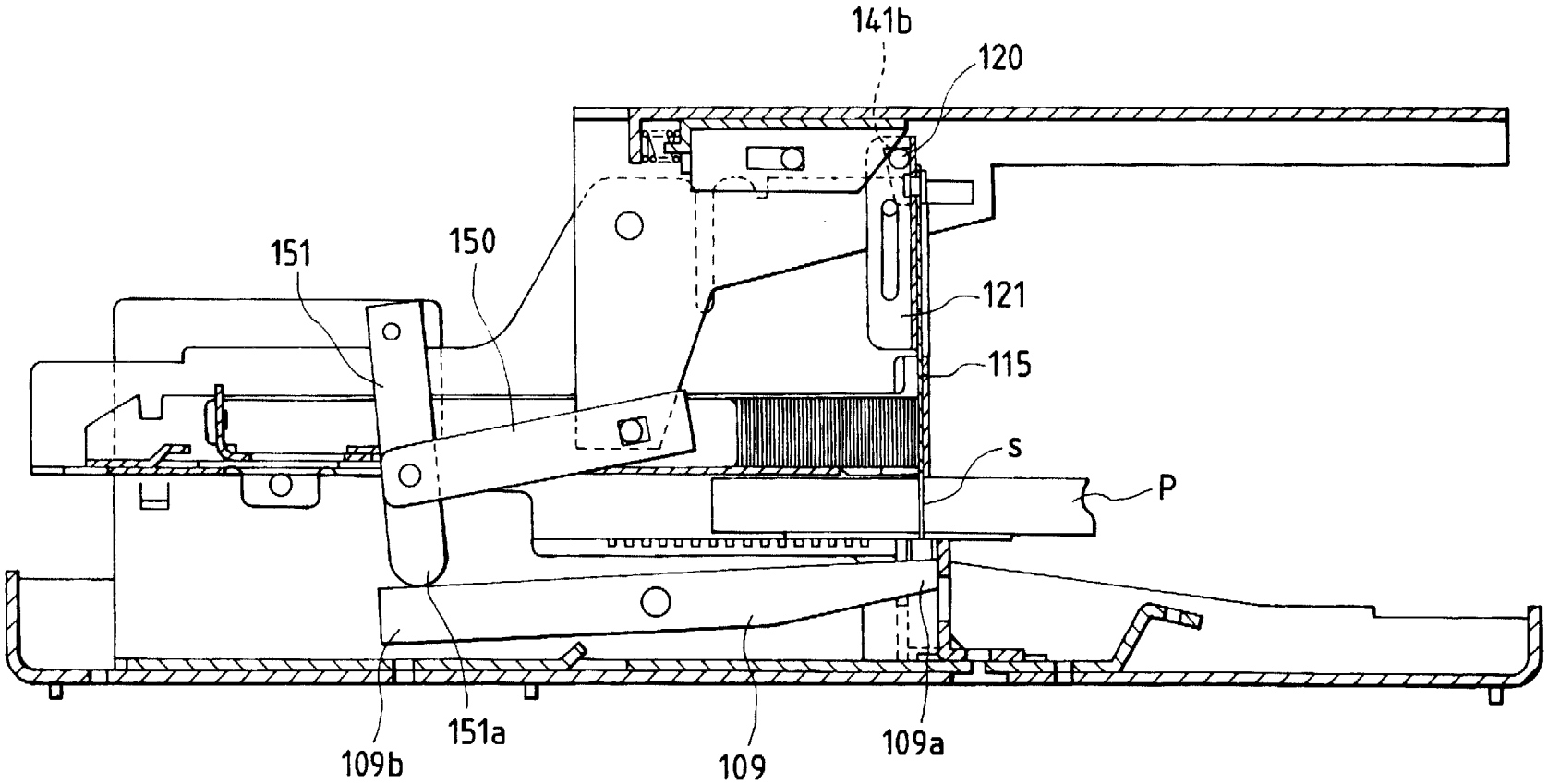
FIG. 24 is a diagram illustrative of how a movable clincher operating mechanism of the stapler is operated.

In the aforementioned construction, when the operating handle 103 is turned, the operating pin 120 that has engaged with the horizontally extending groove 141*a* cannot escape as shown in FIG. 22. Under this condition, the driver holder 121 is moved downward to thereby cause the driver 115 to allow the legs of the staples s to pierce the pile of sheets P. In this case, the driver holder 121 is set so that the driver holder 121 nearly reaches the bottom dead point thereof when the operating pin 120 is moved to the position at which the horizontally extending groove 141*a* is coupled to the vertically extending groove 141*b* as shown in FIG. 23. When the operating handle 103 is moved further downward as shown in FIG. 24, the operating pin 120 is guided to the vertically extending groove 141*b*. As a result, the driver holder 121 does not move any further downward and thus temporarily stops in stand-by position.

Then, the operating pin 120 is set so that the operating pin 120 engages with the upper end of the vertically extending groove 141*b* immediately before reaching the bottom dead point of the operating handle 103 by the movement of the operating handle 103 while the drive holder 121 is in the stand-by position. As a result, the operating pin 120 is moved downward together with the drive holder 121 again immediately before the downwardly moving end of the operating handle 103, which in turn moves the driver 115 downward as well.

The operating mechanism of the movable clinchers 106 is so set that the operating mechanism operates so as to interlock with the downward movement of the operating handle 103 during the stoppage of the drive holder 121 in stand-by position.

The operating mechanism includes an operating member and a link mechanism. The operating member 109 may be constructed in the same manner as that of the aforementioned embodiment; i.e., the operating member 109 is urged so that the movable clinchers 106 are opened.

The link mechanism includes: a first link 150 rotatably coupled to an extension 103*a* of the operating handle 103; and a second link 151 coupled to a shaft 147 of a rising portion 148 on one end of the base member 101. An end portion 150*a* of the first link 150 is coupled to the middle part of the second link 151 by a shaft 152. An end portion 151*a* of the second link 151 engages with the upper surface of the rear end portion 109*b* of the operating member 109.

When the operating handle 103 is moved further downward as shown in FIG. 24 while the driver holder 121 is in stand-by position, the extension 103*a* of the operating handle 103 operates the link mechanism during this latter half movement of the operating handle 103, so that the first link 150 turns the second link 151 and the second link 151 turns the operating member 109. As a result, the legs of the staples s that have pierced the pile of sheets P are bent as shown in FIG. 18(*b*). When the operating handle 103 is moved further downward after the bending, the driver 115 is strongly pressed onto the pile of sheets P by the driver holder 121 that has moved together with the operating member 109, so that the legs of the staples s can be bent more reliably. The binding operation is thus completed.

When the operating handle 103 is turned upward after the binding operation has been completed, the driver operating mechanism and the clincher operating mechanism return to the original positions.

The aforementioned link mechanism may be constructed differently as long as the operating member 109 is designed to be turned.

Figure 25:
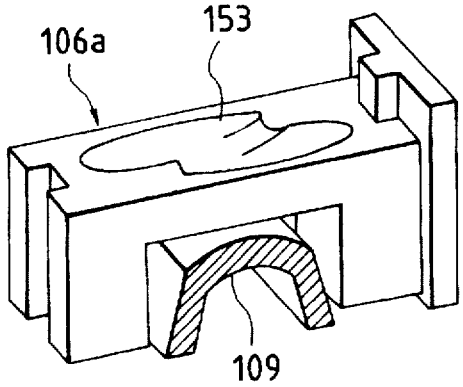
FIG. 25 is a perspective view of another exemplary movable clincher.

Moreover, the construction of the movable clincher is not limited to such design that the pair of movable clinchers is turned as described above. For example, as a movable clincher 106*a* shown in FIG. 25, a clincher groove 153 may be formed in the upper surface and may be disposed so as to be vertically movable, and such a movable clincher 106*a* may be vertically moved by the same operating member 109 as that of the aforementioned embodiment.

Figure 26:
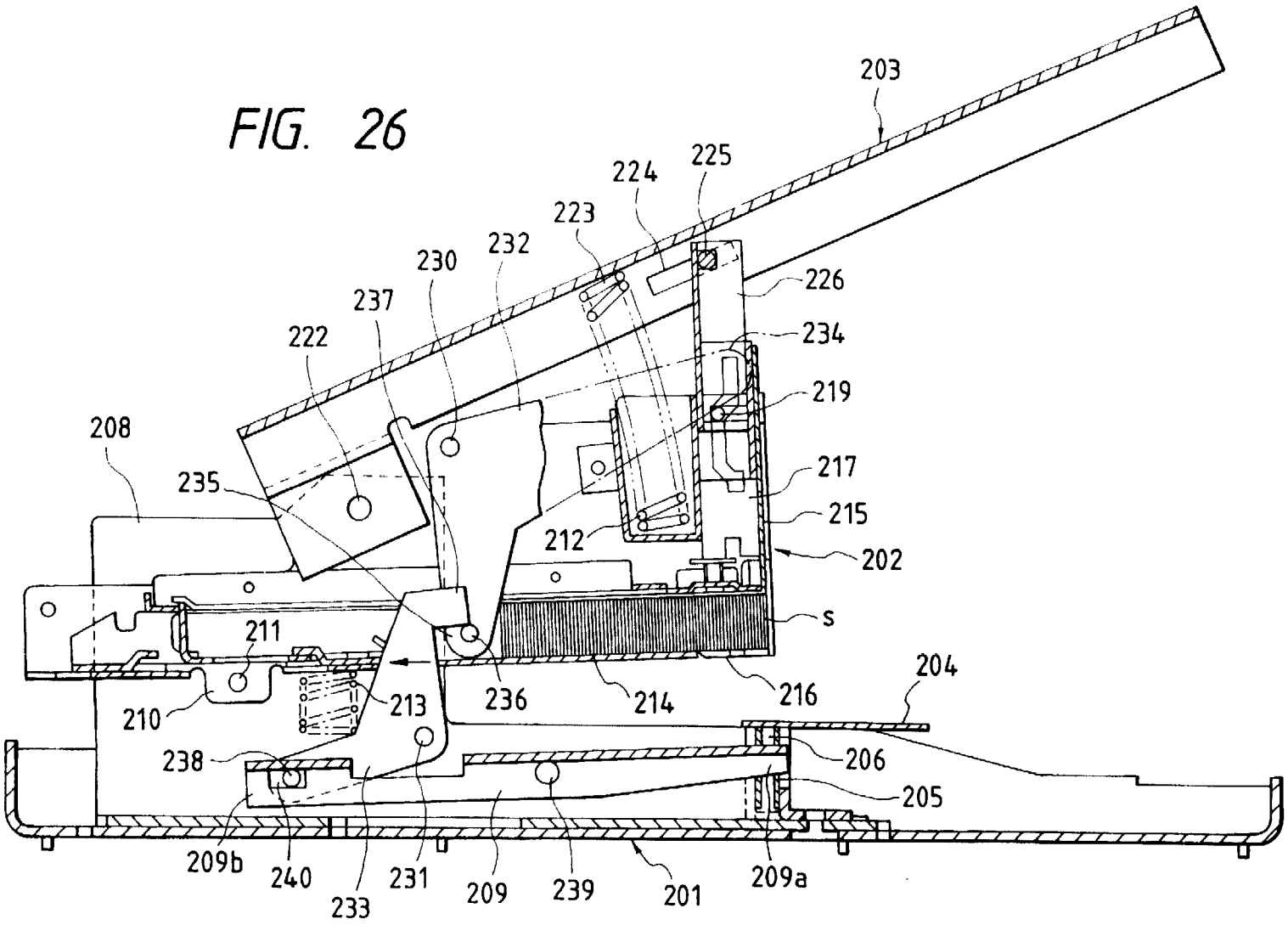
FIG. 26 is a sectional view of still further stapler including a movable clincher operating mechanism of the invention.

FIG. 26 shows still further stapler of such a type as to be used while placed on a desk. In FIG. 26, reference numeral 1 denotes a base member; 202, a frame member; and 203, an operating handle.

A binding table 204 is formed on the upper and almost middle part of the base member 201. A pair of movable clinchers 206 are arranged on support plates 205 so as to be rotabable about shafts 207, respectively (see FIG. 29(*a*)). The support plates 205 are located below the binding table 204. Rising walls 208 are formed on both front sides of the base member 201 so as to project from the base member 201. It may be noted that an operating member 209, which will be described later, is disposed on the base member 201.

Supporting pieces 210 project downward from both front sides of the frame member 202. These supporting pieces 210 are not only supported by a journal 211 so that the frame member 202 can turn with respect to the base member 201, but also urged so that the frame member 202 can rotate upward at all times with a spring 213. In addition, inside the frame member 202 is a magazine unit 214. The magazine unit 214 is so formed as to accommodate staples s therein. It may be noted that a hammering opening 216 is formed so as to pass through the upper and lower portions on the rear end of the magazine unit 214. The hammering opening is designed to allow the driver 215 and the forefront staple s to be hammered out.

On the rear portion of the frame member 202 is a spring shoe 212 for receiving a spring 223. A wall 217 that is square C-shaped in cross section is integrally formed with the front portion of the spring shoe 212. The wall 217 serves to form a sliding groove shown in FIG. 30. The square C-shaped wall 217 has a first guide groove 218 which vertically extends in form of Z-shape. The first guide groove 218 has an upper groove portion 218*a* and a lower groove portion 218*b* coupled through an inclined groove portion 218*c*. An operating pin 219 is slidably engaged with the first guide grooves 218.

Further, the driver holder 220 is guided and held by the sliding groove so as to be vertically slidable. The driver holder 220 is square C-shaped in cross section, holds the driver 215 in a middle piece thereof, and has a second guide groove 21 horizontally extending straight in a side piece 220*b* thereof. The operating pin 219 is slidably engaged also with the second guide groove 221.

Figure 30:
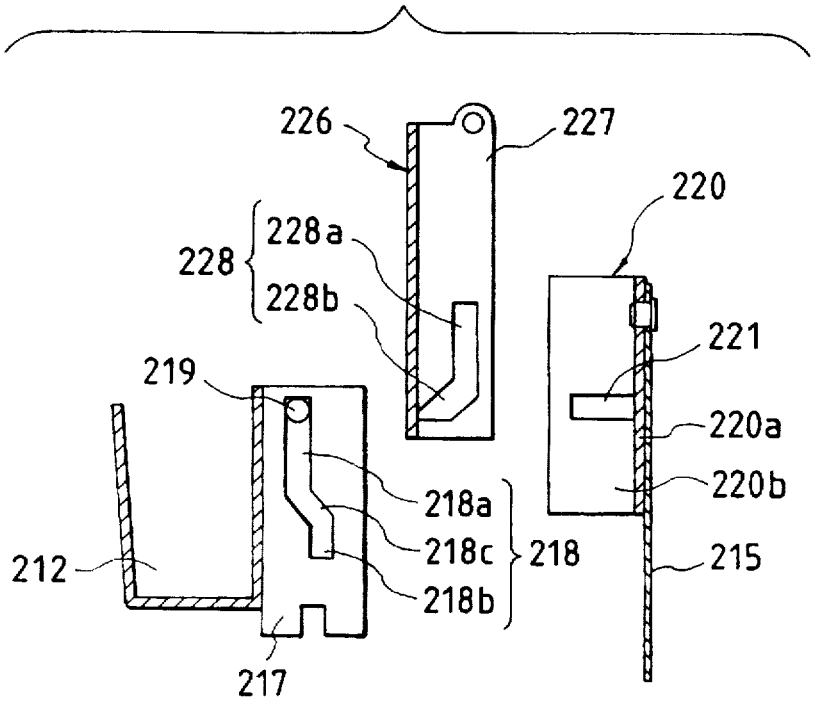
FIG. 30 is an exploded perspective vie of a driver operating mechanism of the stapler.

The operating handle 203 is supported by a journal 222 so that the operating handle 203 can turn with respect to the base member 201. The journal 222 passes through the rising walls 208 of the base member 201. The operating handle 203 is also urged by a spring 223 that is arranged in the spring shoe 212 so that the operating handle 203 can turn upward with respect to the frame member 202 at all times. Further, an elongated hole 224 is formed in a side wall of the middle part of the operating handle 203, and an operating means 226 of the driver 215 is coupled to an engaging shaft 225 that is engaged with the elongated hole 224. The operating means 226 is also square C-shaped in cross section, and is held by the sliding groove of the frame member 202 so as to be vertically slidable. A third guide groove 228 is in form of J-shape in a side piece of the operating means 226 as shown in FIG. 30. The third guide groove 228 has a longitudinal groove portion 228*a* which vertically extends and an inclined groove portion 228*b* formed continuously. The operating pin 219 is slidably engaged also with the third guide grooves 228.

The driver operating mechanism includes: the sliding groove of the frame member 202, the driver holder 220, and the operating means 226 of the operating handle 203.

Then, the stapler has an operating mechanism that operates the movable clinchers 206. This clincher operating mechanism includes: a linklike operating member 209 having a rear end 209*a* thereof arranged below the movable clinchers 206 with the middle part thereof being rotatably disposed on the base member 201, and a link mechanism that interlocks with the operating handle 203.

Figure 29A:
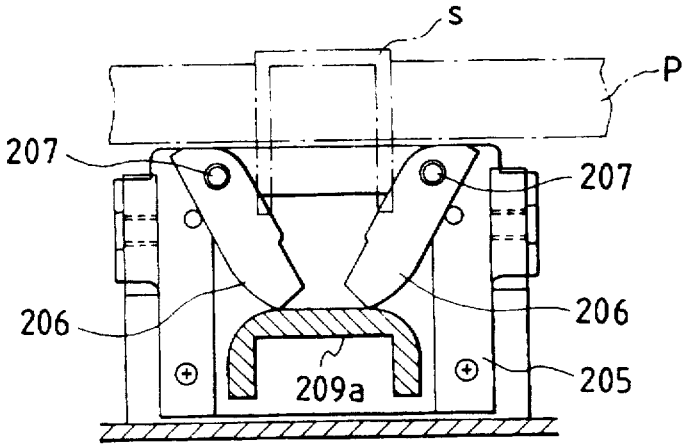
FIGS. 29(*a*) and 29(*b*) are illustrative of how the movable clinchers are opened and closed.
Figure 29B:
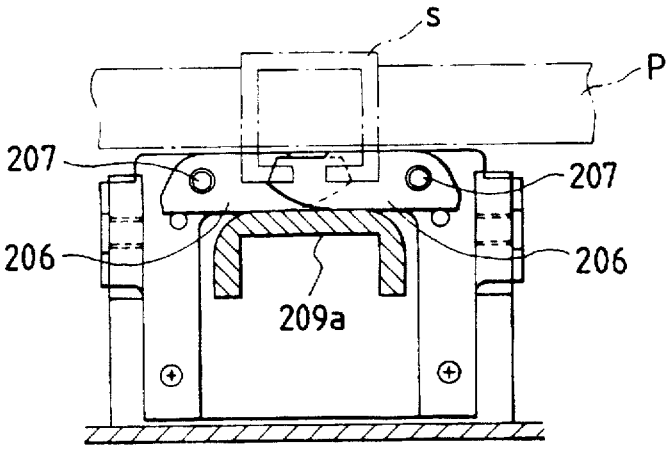
Figure 27:
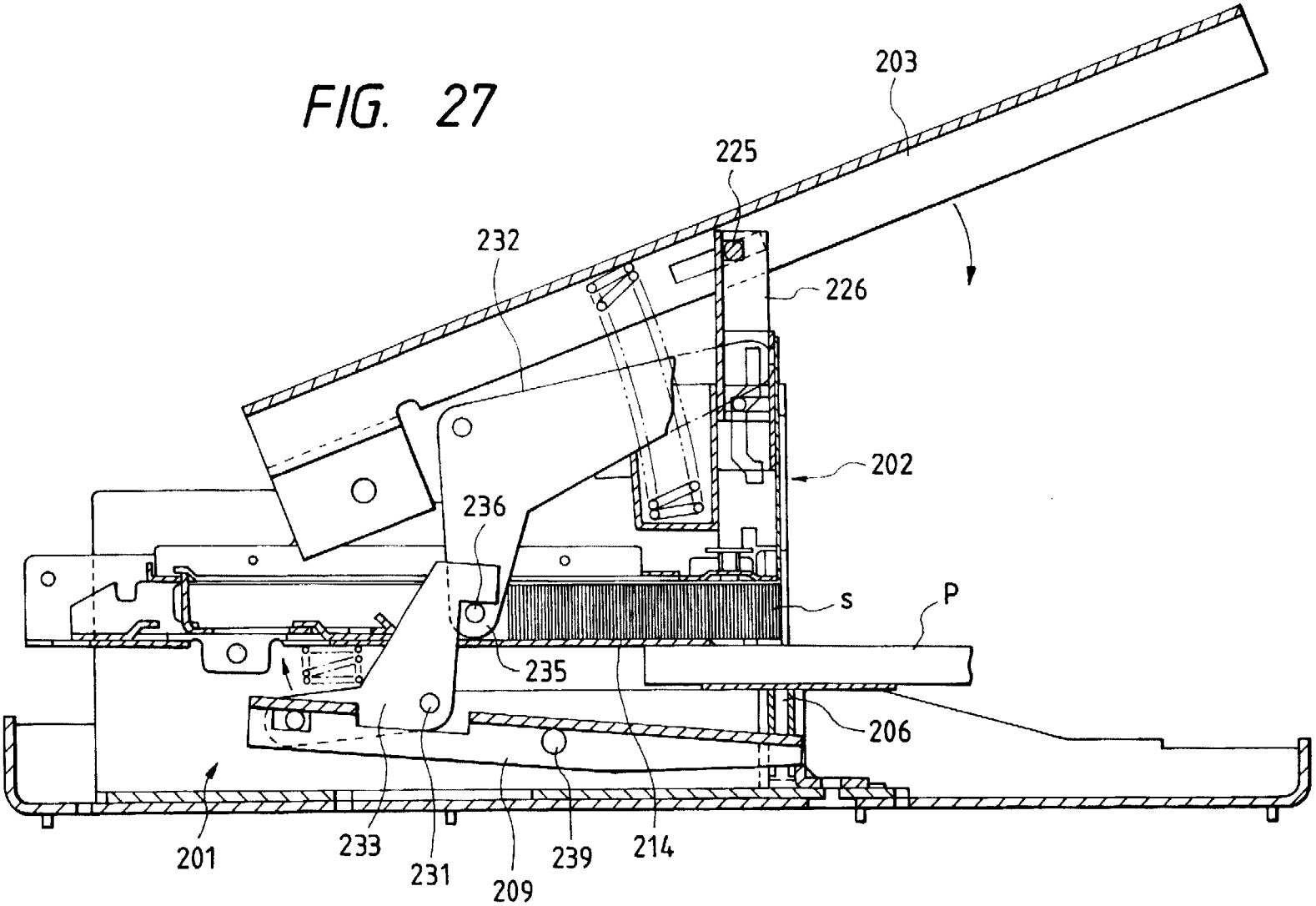
FIG. 27 is a diagram illustrative of how the movable clincher operating mechanism of the stapler is operated immediately before the binding operation.
Figure 28:
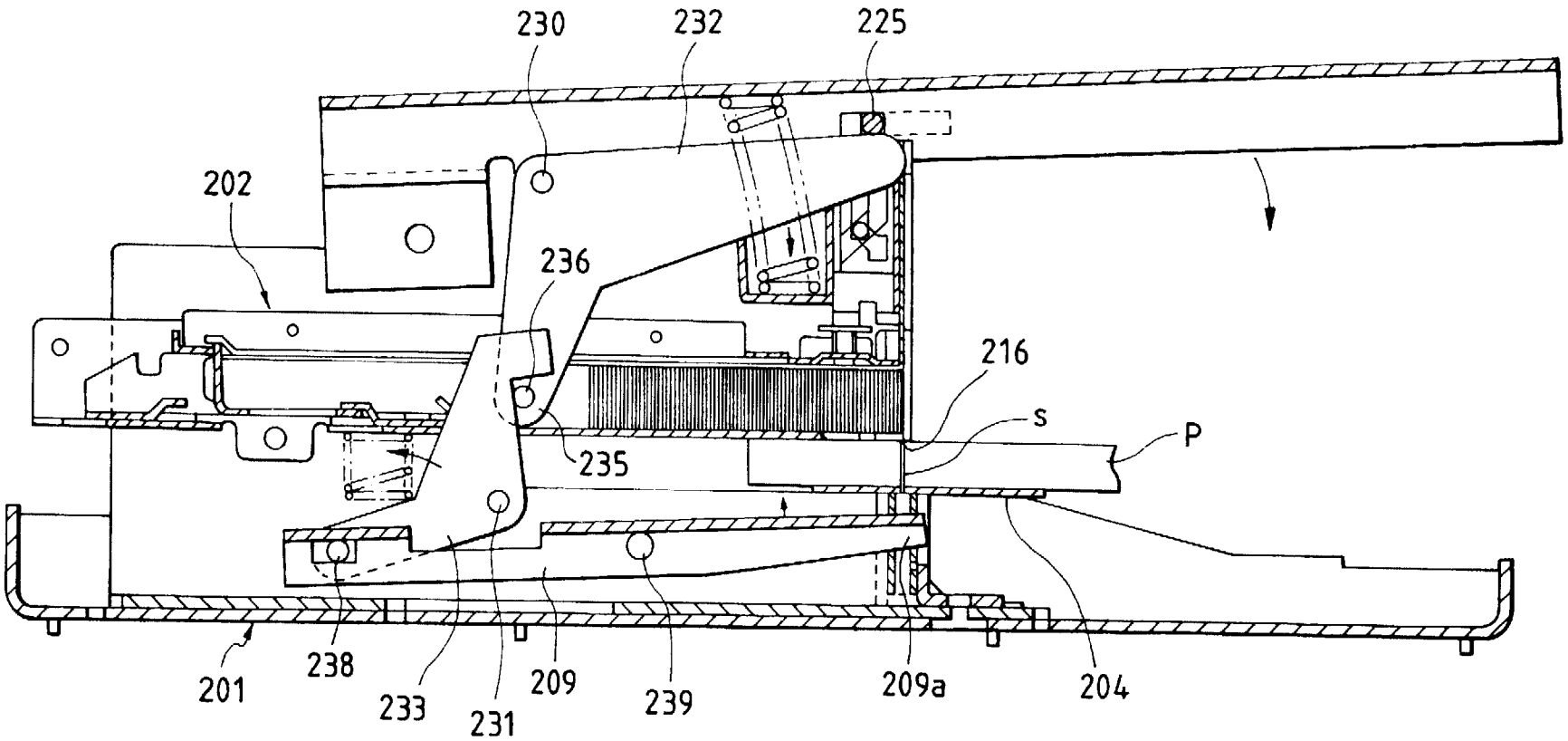
FIG. 28 is a diagram illustrative of how the movable clincher operating mechanism of the stapler is operated at the time of bending staples.

The operating member 209 is arranged so as to be movable to a first position (the position shown in FIGS. 26, 28, 29(*b*)) that closes the movable clinchers 206 (to bend the staples) by turning about a projection 237, and to a second position (the position shown in FIGS. 27 and 29(*a*)) that opens the movable clinchers 206 (to free the staples).

As shown in FIG. 26, the link mechanism includes: a first link 232 and a second link 233 whose middle parts are supported by a first rotary shaft 230 arranged on a side wall of the frame member 202 and a second rotary shaft 231 arranged on the base member 201. One end portion 234 of the first link 232 is arranged so as to be engageable with the lower portion of the operating handle 203, and an operating shaft 236 is arranged on the other end thereof. Further, one end of the second link 233 (upper end portion) has the projection 237 formed so as to project like a latch rearward, and a coupling shaft 238 is fixed to the other end (the lower end portion) so as to pass through an opening 240 of the operating member 209.

When the binding operation is not performed, the frame member 202 is set in the upper position as shown in FIG. 26, and the operating shaft 236 of the first link 232 pushes the lower surface of the projection 237 of the second link 233 upward to thereby turn the second link 233 counterclockwise. As a result, the operating member 209 is held in the first position (the position at which the movable clinchers 206 are closed) while resisting the pressure of the spring.

According to the aforementioned construction, when the operating handle 203 is turned, the operating handle 203 and the frame member 202 turn downward while keeping the same relative positional relationship until the magazine unit 214 comes in contact with the pile of sheets P by resistance between the members as shown in FIG. 27. As a result of the turning, the operating shaft 236 moves downward together with the first link 232 of the link mechanism, which then turns the second link 233 clockwise, causing the front end 209*b* of the operating member 209 engaged with the coupling shaft 238 to move upward. Hence, the rear end 209*a* of the operating member 209 moves downward to turn the operating member 209 to the second position, so that the movable clinchers 206 are opened.

Figure 32:
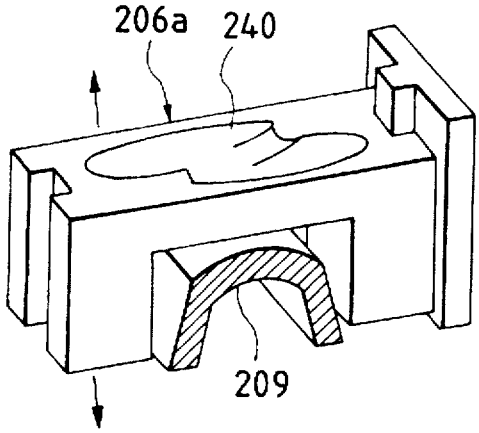
FIG. 32 is a perspective view of another exemplary movable clincher of the stapler.
Figure 33:
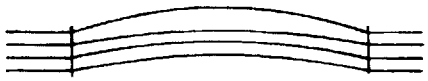
FIG. 33 is a sectional view showing how a pile of sheets is bound by a conventional stapler.
Figures 31A, 31B, 31C, 31D, 31E:
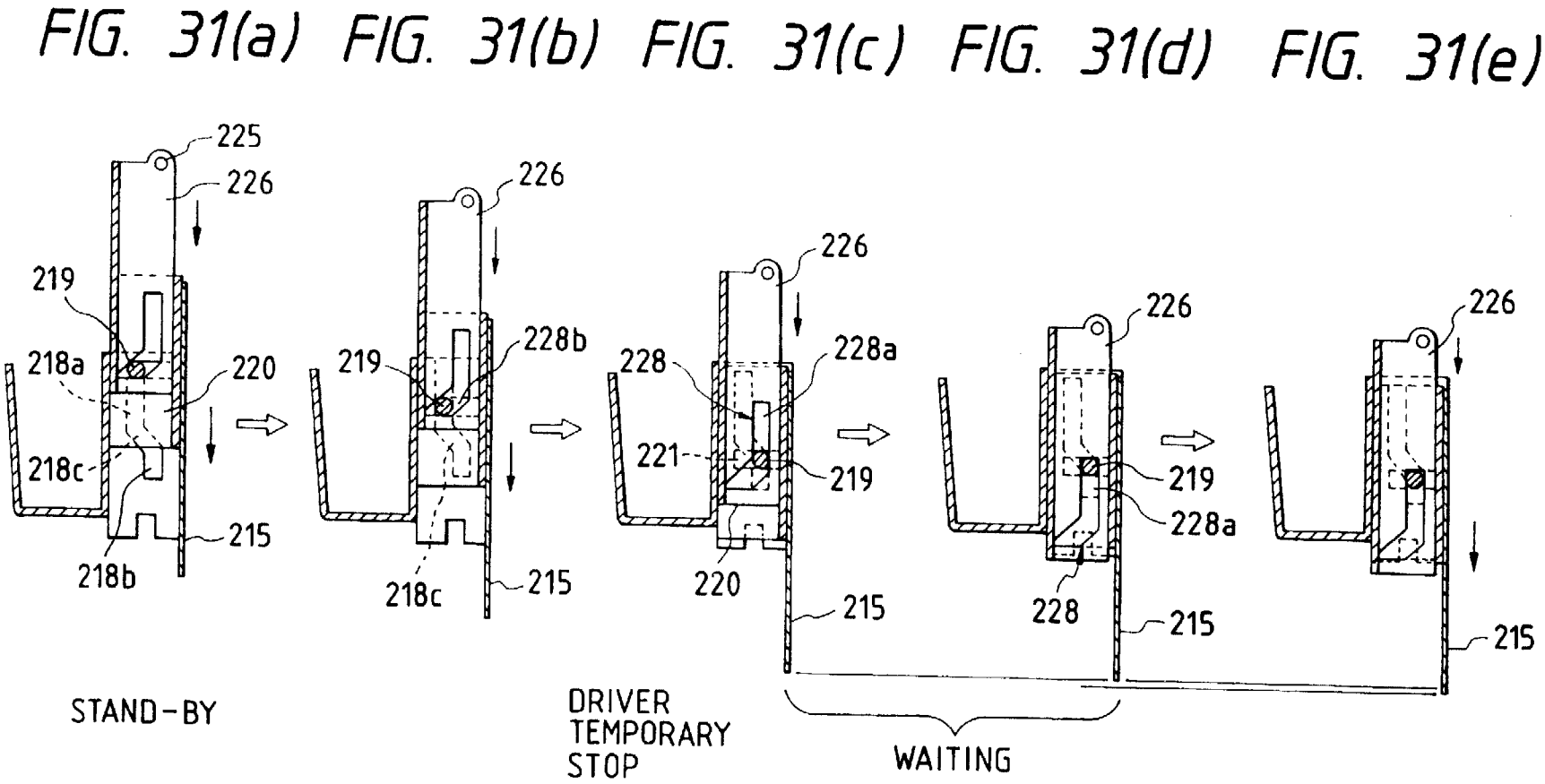
FIGS. 31(*a*), 31(*b*), 31(*c*), 31(*d*), and 31(*e*) are illustrative of how the driver operating mechanism is operated.

When the operating handle 203 is turned further as shown in FIG. 28 after the magazine unit 215 has come into contact with the pile of sheets P, the frame member 202 does not move but the operating means 226 moves downward. At this time, the operating pin 219 moves downward while guided by the upper groove portion 218*a* of the first guide groove 218, which in turn moves the driver holder 220 downward as shown in FIG. 31(*a*), allowing the legs of staples s to pierce the pile of sheets P. The pin 219 thus reaches the inclined groove portion 218*c* of the first guide groove 218. When the operating pin 219 has reached the inclined groove portion 218*c* of the first guide groove 218, the inclined groove portion 218*c* crosses the inclined groove portion 228*b* of the third guide groove 228. As a result, the operating pin 219 moves rightward as viewed in FIG. 31(*b*) while guided by the inclined groove portion 218*c*, the inclined groove portion 228*b*, and the second guide groove 221. When the operating pin 219 has thereafter reached the moving end in the front as shown in FIG. 32(*c*) to thereby enter into the longitudinal groove portion 228*a* of the third guide groove 228 of the operating means 226, the pin 219 escapes by moving along the longitudinal groove portion 228*a* even if the operating means 226 is moved downward. As a result, the driver 215 remains stopped. It is so set that the driver holder 217 nearly reaches the bottom dead point thereof at this moment. The operating pin 219 continues to remain stopped up to this moment. The operating pin 219 is so set that the operating pin 219 engages with the upper end of the longitudinal groove portion 228*a* immediately before reaching the bottom dead point of the operating handle 203. As a result, the operating pin 219 is moved downward again together with the operating means 226 immediately before the moving end of the operating handle 203 (see FIG. 31(*e*)). Hence, the driver 215 also moves downward.

During the downward movement of the operating handle 203, the driver 216 temporarily stops immediately before reaching the bottom dead point thereof as described above. And it is so set that the movable clincher 206 operating mechanism operates while interlocking with the latter downward movement of the operating handle 203 by engaging the engaging shaft 225 of the operating handle 203 with the end portion 234 of the first link 232 as shown in FIG. 28 while the driver 215 is in stand-by position. As a result, the engaging shaft 225 of the operating handle 203 engages with the end portion of the first link 232 of the link mechanism to thereby press such end portion downward during the latter half movement of the operating handle 203. Thus, the engaging shaft 225 of the operating handle 203 turns about the first rotary shaft 230 clockwise, which in turn causes the second link 233 to turn about the second rotary shaft 231 counterclockwise with the shaft 236 pushing the rear end surface of the second link 233. As a result, the coupling shaft 238 on the end portion of the second link 233 turns the operating member 209 so that the operating member 209 of the base member 201 turns about the shaft 239 to the first position, causing the rear end 209*a* of the operating member 209 to elevate and turn (close) the movable clinchers 206 as shown in FIG. 29(*b*). Hence, the legs of the staples s that have pierced the pile of sheets P are bent.

Since the operating pin 219 of the driver operating mechanism engages with the upper end of the longitudinal groove portion 228*a* of the third guide groove 28 as shown in FIG. 31(*e*) immediately before reaching the bottom dead point of the operating handle 203, the staples are pressed downward with the driver 215 having moved to the bottom dead point thereof, so that the bending operation can be reliably performed and completed.

When the operating handle 203 is turned upward after the bending operation has been completed, the driver operating mechanism and the clincher operating mechanism return to the original positions, allowing the operating member 209 to be held in the first position (the position at which the movable clinchers 206 are closed) again.

As described above, it is only when the frame member 202 comes in contact with the upper surface of the pile of sheets P that the movable clinchers 206 are opened; i.e., the movable clinchers 206 are normally closed. Therefore, it is not likely that the movable clinchers 206 will be blocked from turning by a staple entering into the movable clinchers 206.

In addition, since the aforementioned mechanism requires no such special components and mechanisms as to close the movable clinchers 206, a low cost of manufacture can be ensured.

It may be noted that the link mechanism may have other constructions as long as the operating member 9 is designed to be turned.

Further, the construction of a movable clincher is not limited to the pair of movable clinchers as exemplified above. For example, as a movable clincher 207*a* shown in FIG. 32, a clincher groove 253 may be formed in the upper surface so that the movable clincher is arranged so as to be vertically movable; such movable clincher 207*a* may be moved vertically by an operating member 210 of the same construction as described above; and as a result of this construction, the movable clincher may be moved to a first position (the upper position) for bending staples and to a second position (the lower position) for freeing the staples.

The distances moved by the operating handle and the frame member until the frame member comes in contact with the upper surface of a pile of sheets vary from one thickness of a pile of sheets to another. However, since the paper thickness adjusting mechanism that prevents the operating member from regularly operating independently of the thickness of a pile of sheets is arranged, the timings at which to operate the driver operating mechanism and the link mechanism can be kept constant irrespective of the thickness of a pile of sheets by moving the operating handle further downward. As a result, satisfactory binding operation can be ensured at all times.

Further, binding operation is performed without operating the clinchers with respect to the base member, so that satisfactory binding conditions can be obtained.

What is claimed is:

1. A stapler for piercing staples to a pile of sheets and bending legs of the staples, comprising:

a movable clincher for bending the legs of staples along a bottom surface of the pile of sheets;

a base member accommodating said movable clincher;

a clincher operating mechanism for operating said movable clincher;

a magazine in which the staples are loaded;

a driver holder having a first guide groove;

a driver attached to said driver holder, for hammering the forefront staple;

a frame member having a second guide groove, and connecting to said base member swingable with respect to said base member wherein said frame member accommodates said magazine and said frame member supports said driver holder vertically movable;

an operating handle having a third guide groove, and supported by said base member to be vertically movable; and an operating pin is engaged with said first, second and third guide grooves, for regulating a movement of said driver while interlocking with a movement of said operating handle to temporarily stop said driver immediately before said driver reaches a bottom dead point thereof.

2. The stapler according to claim 1, wherein instead of forming said first and second guide grooves in said driver holder, and said frame member, respectively, said operating pin is formed on said driver holder and engages with said third guide groove, for controlling the movement of said driver by said operating pin guided by said third guide groove while interlocking with the movement of said operating handle.

3. A stapler for piercing staples to a pile of sheets and bending legs of the staples, comprising:

a movable clincher for bending the legs of staples along a bottom surface of the pile of sheets;

a base member accommodating said movable clincher;

a clincher operating mechanism for operating said movable clincher;

a magazine in which the staples are loaded;

a driver holder;

a driver attached to said driver holder, for hammering the forefront staple;

a frame member connecting to said base member swingable with respect to said base member wherein said frame member accommodates said magazine and said frame member supports said driver holder vertically movable;

an operating handle supported by said base member to be vertically movable; and a driver-and-clincher mechanism for operating said driver and said clincher such that said driver-and-clincher operating mechanism operates said driver until said driver nearly reaches a bottom dead point thereof during a first half downward movement of said operating handle and then said driver-and-clincher mechanism operates said clincher during a latter half movement of said operating handle.

4. The stapler according to claim 3, wherein said driver-and-clincher mechanism includes:

a first guide groove formed in said frame member;

a second guide groove formed in said driver holder;

a third guide groove formed in said operating handle; and an operating pin is engaged with said first, second and third guide grooves, for regulating a movement of said driver while interlocking with a movement of said operating handle to temporarily stop said driver immediately before said driver reaches a bottom dead point thereof.

5. The stapler according to claim 4, wherein said first guide groove of said frame member is in form of Z-shape, said second guide groove of said driver holder horizontaly extends straight, and said third guide groove of said operating handle is in form of J-shape.

6. The stapler according to claim 3, wherein said driver-and-clincher mechanism includes:

a guide groove formed in said operating handle; and an operating pin formed on said driver holder and engaging with said guide groove, for controlling the movement of said driver by said operating pin guided by said guide groove while interlocking with the movement of said operating handle.

7. The stapler according to claim 3, wherein said driver-and-clincher mechanism includes:

a paper thickness adjusting mechanism for preventing said operating member from operating irrespective of the thickness of a pile of sheets until said frame member comes in contact with an upper surface of the pile of sheets.

8. The stapler according to claim 3, wherein said driver-and-clincher mechanism includes:

an operating member arranged on the base member so as to be movable to a first position at which said movable clincher is operated to bend the staples and to a second position at which said movable clincher frees the staples, and a link mechanism allowing said operating member to move from said second position to said first position while interlocking with a downward movement of said operating handle, wherein, when the frame member is located at an upper position, said link mechanism is located at such a position as to allow said operating member to move toward said first position, and when said frame member is moved downward, said link mechanism is located at such a position as to allow said operating member to move toward said second position.

* * * * *